US005701691A

United States Patent [19]

Watanabe et al.

[11] Patent Number: 5,701,691

[45] Date of Patent: Dec. 30, 1997

[54] REGION LIMITING EXCAVATION CONTROL SYSTEM FOR CONSTRUCTION MACHINE

[75] Inventors: Hiroshi Watanabe; Toichi Hirata, both of Ushiku; Masakazu Haga, Ibaraki-ken; Eiji Yamagata, Ibaraki-ken; Kazuo Fujishima, Ibaraki-ken; Hiroyuki Adachi, Tsuchiura, all of Japan

[73] Assignee: Hitachi Construction Machinery Co., Ltd., Tokyo, Japan

[21] Appl. No.: 596,103

[22] PCT Filed: May 31, 1995

[86] PCT No.: PCT/JP95/01053

§ 371 Date: Jan. 31, 1996

§ 102(e) Date: Jan. 31, 1996

[87] PCT Pub. No.: WO95/33100

PCT Pub. Date: Dec. 7, 1995

[30] Foreign Application Priority Data

Jun. 1, 1994 [JP] Japan ..... 6-119874

[51] Int. Cl.[6] ..... E02F 5/02

[52] U.S. Cl. ..... 37/348; 172/4; 414/699; 364/424.07

[58] Field of Search ..... 37/348, 382, 466; 172/4, 4.5, 5; 414/699, 700, 701, 695.5; 364/424.07, 182, 174

[56] References Cited

U.S. PATENT DOCUMENTS

| | | | |
|---|---|---|---|
| 5,198,800 | 3/1993 | Tozawa et al. | 364/424.07 X |
| 5,490,081 | 2/1996 | Kuromoto et al. | 364/424.07 X |

FOREIGN PATENT DOCUMENTS

| | | | |
|---|---|---|---|
| 2 660 948 | 3/1991 | France . | |
| 41 10 959 | 4/1991 | Germany . | |
| 63-219731 | 9/1988 | Japan . | |
| 401271536 | 10/1989 | Japan | 364/424.07 |
| 85424 | 3/1990 | Japan | 364/424.07 |
| 403208923 | 9/1991 | Japan | 37/348 |
| 403221628 | 9/1991 | Japan | 37/348 |
| 4-11128 | 1/1992 | Japan . | |
| 4-136324 | 5/1992 | Japan . | |
| 6-193090 | 12/1994 | Japan . | |
| 2222997 | 3/1990 | United Kingdom | 364/424.07 |
| 2 243 359 | 10/1991 | United Kingdom . | |
| 2 272 204 | 11/1994 | United Kingdom . | |

*Primary Examiner*—Terry Lee Melius
*Assistant Examiner*—Thomas A. Beach
*Attorney, Agent, or Firm*—Fay, Sharpe, Beall, Fagan, Minnich & McKee

[57] ABSTRACT

In an excavation area limiting control system for a construction machine for limitingly controlling an area to be excavated, a region where a front device 1A is movable is set beforehand. The position and posture of the front device are calculated based on signals from angle sensors 8a–8c, and a target speed vector of the front device is calculated based on detection signals from control lever units and load pressures detected by pressure sensors 270a to 271b. The target speed vector is modified so that a vector component of the target speed vector in the direction toward the boundary of the set region is reduced when the front device is within the set region near the boundary thereof, and the front device is returned to the set region when the front device is outside the set region. Control signals corresponding to the modified target speed vector are further modified depending on the load pressures and output to proportional solenoid valves 210a to 211b. As a result, the excavation within a limited area can be implemented efficiently and smoothly, and stable control is achieved with good accuracy regardless of change in the load pressures of hydraulic actuators.

21 Claims, 26 Drawing Sheets

REGION LIMITING EXCAVATION CONTROL SYSTEM FOR CONSTRUCTION MACHINE

TECHNICAL FIELD

The present invention relates to a region limiting excavation control system for a construction machine, and more particularly to a region limiting excavation control system which is mounted on a construction machine such as a hydraulic excavator a multi-articulated front attachment which can perform excavation while limiting the region where the front attachment is movable.

BACKGROUND ART

There is known a hydraulic excavator type of construction machine. A hydraulic excavator is made up by a front attachment comprising a boom, an arm and a bucket which are each rotatable in the vertical direction, and a body comprising an upper structure and an undercarriage, the boom of the front attachment having its base end supported to a front portion of the upper structure. In such a hydraulic excavator, the front members such as the boom are operated by respective manual control levers. However, because the front members are coupled to each other in an articulated manner for pivotal motion, it is very difficult to carry out excavation work over a predetermined region by controlling the front members. In view of the above, a region limiting excavation control system is proposed in JP, A, 4-136324 for facilitating the excavation work. The proposed region limiting excavation control system comprises means for detecting a posture of a front attachment, means for calculating a position of the front attachment based on a signal from the detecting means, means for teaching an entrance forbidden region where the front attachment is inhibited from entering, lever gain calculating means for determining the distance d between the position of the front attachment and a boundary line of the taught entrance forbidden region, and outputting the product of a lever control signal multiplied by a function depending on the distance d that takes a value 1 when the distance d is greater than a certain value, and a value between 0 and 1 when it is smaller than the certain value, and actuator control means for controlling motion of an actuator in accordance with a signal from the lever gain calculating means. With the construction of the proposed system, since the lever control signal is restricted depending on the distance to the boundary line of the entrance forbidden region, even when the operator attempts to move the end of the bucket into the entrance forbidden region by mistake, the bucket end is smoothly stopped at the boundary line automatically, or on the way of movement of the bucket end to the boundary line, the operator can notice the movement approaching the entrance forbidden region, judging from a reduction in the speed of the front attachment, and return the Further, JP, A, 63-219731 discloses a hydraulic excavator wherein a work limit position beyond which the work carried out by a front attachment may encounter any trouble is set, and an arm is controlled to return its end into a work permitted region if the arm end goes out of the work limit position.

DISCLOSURE OF THE INVENTION

However, the above-mentioned prior arts have problems as follows.

With the prior art disclosed in JP, A, 4-136324, since the lever gain calculating means outputs, to the actuator control means, the product of the lever control signal multiplied by the function depending on the distance d, the bucket end is gradually slowed down as it approaches the boundary of the entrance forbidden region, and is finally stopped at the boundary of the entrance forbidden region. Therefore, a shock that would otherwise be generated when the operator attempts to move the bucket end into the entrance forbidden region can be avoided. But, this prior art is arranged to reduce the speed of the bucket end such that the speed is always reduced regardless of the direction in which the bucket end is moving. Accordingly, when excavation is performed along the boundary of the entrance forbidden region, the digging speed in the direction along the boundary of the entrance forbidden region is also reduced as the bucket end approaches the entrance forbidden region with operation of the arm. This requires the operator to manipulate a boom lever to move the bucket end away from the entrance forbidden region each time the digging speed is reduced, in order to prevent a drop of the digging speed. As a result, the working efficiency is extremely deteriorated when excavation is performed along the entrance forbidden region. Alternatively, to increase the working efficiency, the excavation must be performed at a distance away from the entrance forbidden region, making it impossible to excavate the predetermined region.

With the prior art disclosed in JP, A, 63-219731, if the operating speed is high at the time the arm end moves beyond the work limit position, the amount by which the arm end moves beyond the work limit position is increased and the arm end is abruptly moved back to the work limit position, thereby causing a shock. As a result, the work cannot smoothly be performed.

Further, any of the above stated prior art has not taken account of change in the flow rate characteristic of a hydraulic control valve depending on change in the load pressure of a hydraulic actuator. Therefore, when a flow control valve of center bypass type, particularly, is employed as the hydraulic control valve, the flow rate characteristic of the hydraulic control valve is changed with the load pressure of the hydraulic actuator, producing a difference between the calculated value in control process and the actual movement. This results in the problem that stable control cannot be realized with good accuracy.

A first object of the present invention is to provide a region limiting excavation control system for a construction machine by which excavation can efficiently be performed within a limited region and stable control can be realized with good accuracy regardless of change in the load pressure of a hydraulic actuator.

A second object of the present invention is to provide a region limiting excavation control system for a construction machine by which excavation can smoothly be performed within a limited region and stable control can be realized with good accuracy regardless of change in the load pressure of a hydraulic actuator.

To achieve the above first object, according to the present invention, a region limiting excavation or excavation limiting control system in a construction machine for limitingly controlling an area to be excavated according to the present invention is constructed as follows. Specifically, in a region limiting excavation control system for a construction machine comprising a plurality of driven members including a plurality of front members which make up a multi-articulated type front attachment or device and are vertically rotatable, a plurality of hydraulic actuators for respectively driving the plurality of driven members, a plurality of manipulation means for instructing operation of the plurality of driven members, and a plurality of hydraulic control valves driven in accordance with control signals from the plurality of manipulation means for controlling flow rates of a hydraulic fluid supplied to plurality of hydraulic actuators, wherein the system further comprises (a) region or area setting means for setting a region or area to be excavated where the front attachment is movable; (b) first detecting means for detecting status variables with regard to the position and posture of the front attachment; (c) second detecting means for detecting load pressures of particular front actuators of the plurality of hydraulic actuators which are associated with at least one or more particular front members; (d) first calculating means for calculating the position and posture of the front attachment based on signals from the first detecting means; (e) signal modifying means for, based on the control signals from the manipulation means of the plurality of manipulation means which are associated with the front attachment and the values calculated by the first calculating means, carrying out calculation of a target speed vector of the front attachment and modifying the control signals from the manipulation means associated with the front attachment so that, when the front attachment is within the set region near the boundary of the set region, the front attachment is allowed to move in the direction along the boundary of the set region and a moving speed of the front attachment in the direction toward the boundary of the set region is reduced; and (f) output modifying means for, based on signals from the second detecting means, further modifying, of the control signals modified by the signal modifying means, the control signals from the manipulation means which are associated with the particular front members so that the front attachment is moved as per the target speed vector regardless of change in the load pressures of the particular front actuators.

By so modifying the control signals from the manipulation means associated with the front attachment or device by the signal modifying means, directional change control for slowing down the movement of the front attachment in the direction toward the boundary of the set region is performed, while allowing the front attachment to move along the boundary of the set region. Therefore, the excavation within a limited region can efficiently be implemented.

Further, when the movement of the front attachment is controlled, the control signals are further modified by the output modifying means so that the front attachment is moved as per the target speed vector regardless of change in the load pressures of the particular front actuators. Therefore, even if the flow rate characteristics of the hydraulic control valves are varied with change in the load pressures, the control signals are modified correspondingly. This modification reduces the deviation between the calculated value of the target speed vector on the control basis and the actual movement, and prevents the actual position of the front attachment from deviating from the calculated position on the control basis to a large extent. Accordingly, when digging work is implemented along the boundary of the set region, the work can be controlled with good accuracy in point of, e.g., the front attachment to be precisely moved along the boundary of the set region. Also, stable control is achieved because of yielding no large deviations in the control process.

In the above region limiting excavation control system, preferably, the signal modifying means comprises second calculating means for calculating an input target speed vector of the front attachment based on the control signals from the manipulation means associated with the front attachment, third calculating means for modifying the input target speed vector so that a vector component of the input target speed vector in the direction toward the boundary of the set region is reduced, and valve control means for driving the associated hydraulic control valves so that the front attachment is moved in accordance with the target speed vector modified by the third calculating means, and wherein the output modifying means is constituted as part of the valve control means.

To achieve the above second object, in the region limiting excavation control system according to the present invention, the signal modifying means carries out, based on the control signals from those ones of the plurality of manipulation means which are associated with the front attachment and the values calculated by the first calculating means, calculation of a target speed vector of the front attachment, modifies the control signals from the manipulation means associated with the front attachment so that, when the front attachment is within the set region near the boundary of the set region, the front attachment is allowed to move in the direction along the boundary of the set region and a moving speed of the front attachment in the direction toward the boundary of the set region is reduced, and modifies the control signals from the manipulation means associated with the front attachment so that, when the front attachment is outside the set region, the front attachment is returned to the set region, and wherein the output modifying means further modifies, based on signals from the second detecting means, the control signals from the manipulation means which are associated with the particular front members for any case of modification of the control signals so that the front attachment is moved as per the target speed vector regardless of change in the load pressures of the particular front actuators.

When the front attachment approaches the boundary of the set region under the direction change control as stated above, the front attachment often goes out of the set region due to a delay in control response and the inertia of the front attachment if the movement of the front attachment is fast. In such a case, the signal modifying means modifies the control signals from the manipulation means associated with the front attachment so that the front attachment is returned to the set region. Thus, the front attachment is controlled to quickly return to the set region after going out of the set region. As a result, even if the front attachment is moved fast, it can be along the boundary of the set region and the excavation within a limited region can precisely be implemented.

Also, on this occasion, since the movement of the front attachment is already slowed down through the direction change control as mentioned above, the amount by which the bucket end goes out of the set region is so reduced that the shock occurred upon returning to the set region is greatly alleviated. Therefore, even if the front attachment is moved fast, the excavation within a limited region can smoothly be implemented and the excavation within a limited region can be implemented with no troubles.

In the above region limiting excavation control system, preferably, the signal modifying means includes second calculating means for calculating an input target speed vector of the front attachment based on the control signals from the manipulation means associated with the front attachment, third calculating means for modifying the input target speed vector so that, when the front attachment is within the set region near the boundary of the set region, a vector component of the input target speed vector in the direction toward the boundary of the set region is reduced, and modifying the input target speed vector so that, when the front attachment is outside the set region, the front attachment is returned to the set region, and valve control means for driving the associated hydraulic control valves so that the front attachment is moved in accordance with the target speed vector modified by the third calculating means, and wherein the output modifying means is constituted as part of the valve control means.

In the above region limiting excavation control system, preferably, the valve control means includes fourth calculating means for calculating target operation command values for the associated hydraulic control valves based on the target speed vector modified by the third calculating means, and output means for producing control signals for the associated hydraulic control valves based on the target operation command values calculated by the fourth calculating means, and wherein the output modifying means is constituted as part of the fourth calculating means and, in the calculation of the target operation command values, modifies those ones of the target operation command values which are associated with the particular front actuators, depending on the load pressures detected by the second detecting means.

Also preferably, the fourth calculating means includes target actuator speed calculating means for calculating target actuator speeds from the target speed vector modified by the third calculating means, and target operation command value calculating means for calculating the target operation command values for the associated hydraulic control valves from the target actuator speeds and the load pressures detected by the second detecting means in accordance with preset characteristics.

Further, in the above region limiting excavation control system, the signal modifying means includes second calculating means for calculating an input target speed vector of the front attachment based on the control signals from the manipulation means associated with the front attachment, and third calculating means for modifying the input target speed vector so that a vector component of the input target speed vector in the direction toward the boundary of the set region is reduced, and the region limiting excavation control system further comprises input modifying means for, based on the signals from the second detecting means, modifying the input target speed vector calculated by the second calculating means so that the speed vector corresponding to the control signals from the manipulation means is obtained regardless of change in the load pressures of the particular front actuators.

Thus, since the input target speed vector calculated by the second calculating means is modified by the input modifying means so that the speed vector corresponding to the manipulation of the manipulation means is obtained regardless of change in the load pressures of the particular front actuators, the input target speed vector modified by the third calculating means is modified correspondingly even if the flow rate characteristics of the flow control valves are varied depending on change in the load pressures. In this case, therefore, the deviation between the calculated value of the target speed vector on the control basis and the actual movement is also reduced, resulting in further improved control accuracy.

Preferably, the second calculating means includes fifth calculating means for calculating input target actuator speeds based on the control signals from the manipulation means associated with the front attachment, and sixth calculating means for calculating the input target speed vector of the front attachment from the input target actuator speeds calculated by the fifth calculating means, and the input modifying means is constituted as part of the fifth calculating means and, in the calculation of the input target actuator speeds,. modifies the input target actuator speeds of the particular front actuators depending on the load pressures detected by the second detecting means.

In this case, preferably, the fifth calculating means calculates the input target actuator speeds from the control signals from the manipulation means associated with the front attachment and the load pressures detected by the second detecting means in accordance with preset characteristics.

In any of the above cases, preferably, the preset characteristics are determined based on flow rate load characteristics of the hydraulic control valves associated with the particular front actuators.

In a region limiting excavation control system for a construction machine wherein the plurality of manipulation means are manipulation means of electric lever type generating electric signals as the control signals, preferably, the valve control means includes electric signal generating means for calculating target operation command values for the associated hydraulic control valves based on the target speed vector modified by the third calculating means and outputting electric signals corresponding to the calculated target operation command values, and electro-hydraulic converting means for converting the electric signals into hydraulic signals and outputting the hydraulic signals to the associated hydraulic control valves, and wherein the output modifying means is constituted as part of the electric signal generating means and, in the calculation of the target operation command values, modifies those ones of the target operation command values which are associated with the particular front actuators, depending on the load pressures detected by the second detecting means. With this arrangement, the present invention can be realized in the system employing manipulation means of electric lever type.

Also, in a region limiting excavation control system for a construction machine wherein the plurality of manipulation means are of hydraulic pilot type generating pilot pressures as the control signals and the associated hydraulic control valves are driven by a manipulation system including the manipulation means of hydraulic pilot type, preferably, the valve control means includes electric signal generating means for calculating target operation command values for the associated hydraulic control valves based on the target speed vector modified by the third calculating means and outputting electric signals corresponding to the calculated target operation command values, and pilot pressure modifying means for outputting, in accordance with the electric signals, pilot pressures which are to be substituted for the pilot pressures from the manipulation means, and the output modifying means is constituted as part of the electric signal generating means and, in the calculation of the target operation command values, modifies those ones of the target operation command values which are associated with the particular front actuators, depending on the load pressures detected by the second detecting means.

By thus constructing the valve means so as to include the pilot pressure modifying means, the function of the present invention of efficiently implementing the excavation within a limited region can easily be added to any system including the manipulation means of hydraulic pilot type.

When the manipulation means associated with the front members are boom manipulation means and arm manipulation means of a hydraulic excavator, digging work along the boundary of the set region can be implemented by using just one arm control lever because the control signals (pilot pressures) are output as stated above even when only one control lever of the arm manipulation means is manipulated.

When the present invention is applied to the system employing manipulation means of hydraulic pilot type like the above case, preferably, the manipulation system includes a first pilot line for introducing a pilot pressure to the corresponding hydraulic control Valve so that the front attachment is moved away from the set region, and the pilot pressure modifying means includes electrohydraulic converting means for converting the electric signal into a hydraulic signal and higher pressure selecting means for selecting higher one of the pilot pressure in the first pilot line and the hydraulic signal output from the electro-hydraulic converting means, and introducing the selected pressure to the corresponding hydraulic control valve.

The manipulation system may include second pilot lines for introducing pilot pressures to the corresponding hydraulic control valves so that the front attachment is moved toward the set region, and the pilot pressure modifying means may include pressure reducing means disposed in the second pilot lines for reducing the pilot pressures in the second pilot lines in accordance with the electric signals.

In the above region limiting excavation control system, preferably, the third calculating means maintains the input target speed vector as it is when the front attachment is within the set region but not near the boundary of the set region. With this arrangement, when the front attachment is outside the set region and away from the boundary thereof, the excavation can be implemented in a like manner to normal work. Preferably, the vector component of the input target speed vector in the direction toward the boundary of the set region is a vector component vertical to the boundary of the set region.

Further preferably, when the third calculating means modifies the input target speed vector so that the vector component thereof in the direction toward the boundary of the set region is reduced, it reduces the vector component of the input target speed vector in the direction toward the boundary of the set region such that an amount of reduction in the vector component is increased as a distance between the front attachment and the boundary of the set region decreases.

Also preferably, when the third calculating means modifies the input target speed vector so that the front attachment is returned to the set region, it modifies the input target speed vector by changing a vector component of the input target speed vector in the direction vertical to the boundary of the set region into a vector component in the direction toward the boundary of the set region. By so changing the vector component of the input target speed vector in the direction vertical to the boundary of the set region, the speed component in the direction along the boundary of the set region is not reduced and, therefore, the front attachment can be moved along the boundary of the set region if it goes out of the set region.

Preferably, the third calculating means reduces the vector component in the direction toward the boundary of the set region as a distance between the front attachment and the boundary of the set region decreases. With this arrangement, the path along which the front attachment is returned to the set region is in the form of a curved line which is curved to come closer to a parallel line while approaching the boundary of the set region. This enables the front attachment to be returned to the set region in a smoother manner.

In the above region limiting excavation control system, preferably, the front attachment includes a boom and an arm of a hydraulic excavator. In this case, preferably, the particular front actuators include at least a boom cylinder for driving the boom, and the second detecting means include at least means for detecting a load pressure in the boom-up direction.

BEST MODE FOR CARRYING OUT THE INVENTION

Hereinafter, several embodiments of the present invention when applied to a hydraulic excavator will be described with reference to the drawings.

First Embodiment

A first embodiment of the present invention will be described with reference to FIGS. 1 to 18.

Figure 1:
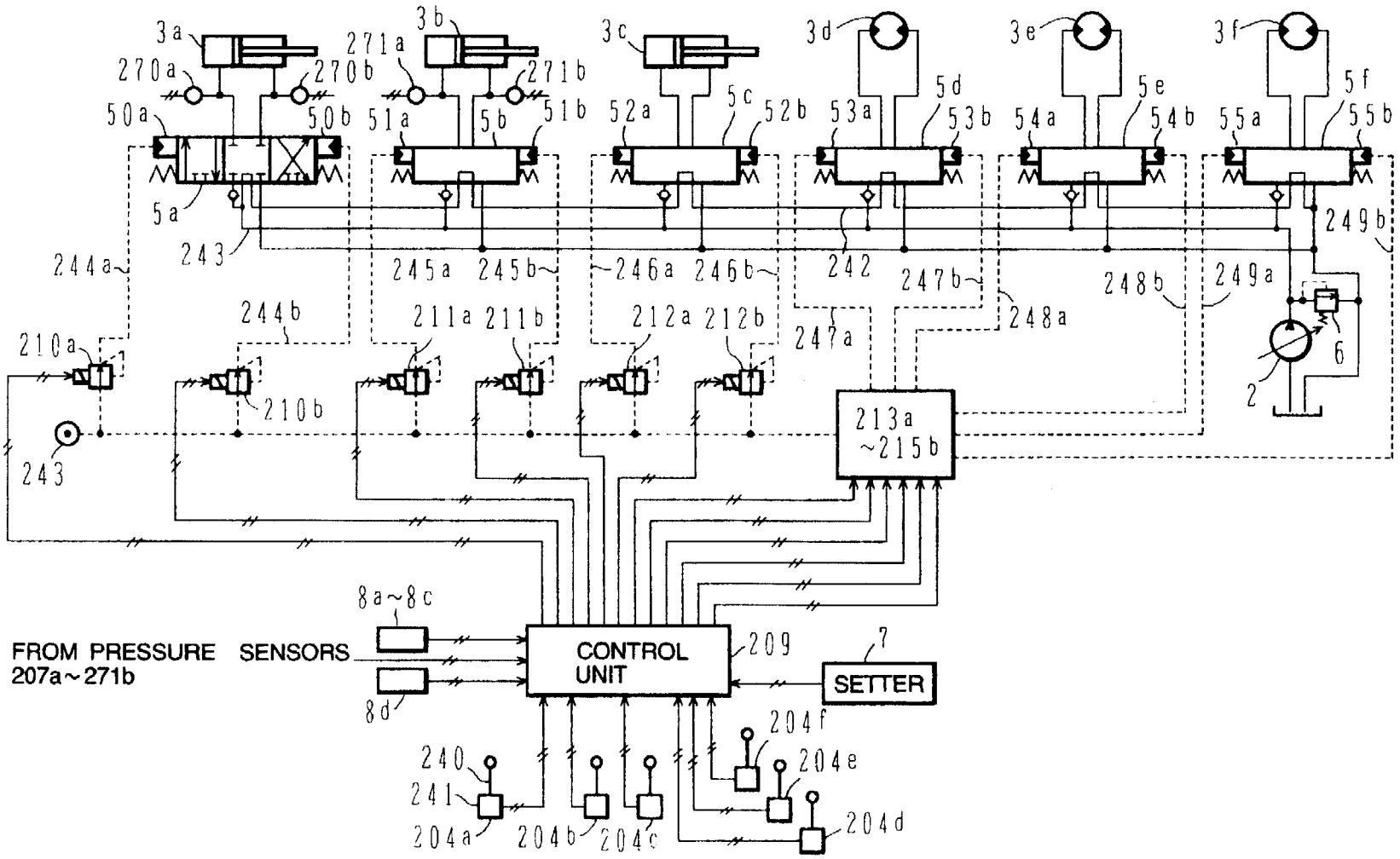
FIG. 1 is a diagram showing a region limiting excavation control system for a construction machine according to a first embodiment of the present invention, along with a hydraulic drive system.

In FIG. 1, a hydraulic excavator to which the present invention is applied comprises a hydraulic pump 2, a plurality of hydraulic actuators driven by a hydraulic fluid from the hydraulic pump 2, including a boom cylinder 3*a*, an arm cylinder 3*b*, a bucket cylinder 3*c*, a swing motor 3*d* and left and right track motors 3*e*, 3*f*, a plurality of control lever units 204*a* to 204*f* provided respectively corresponding to the hydraulic actuators 3*a* to 3*f*, a plurality of flow control valves 5*a* to 5*f* connected respectively between the hydraulic pump 2 and the plurality of hydraulic actuators 3*a* to 3*f* and controlled in accordance with respective control (input) signals from the control lever units 204*a* to 204*f* for controlling flow rates of the hydraulic fluid supplied to the hydraulic actuators 3*a* to 3*f*, and a relief valve 6 which is made open when the pressure between the hydraulic pump 2 and the flow control valves 5*a* to 5*f* exceeds a preset value. The above components cooperatively make up a hydraulic drive system for driving driven members of the hydraulic excavator.

Figure 2:
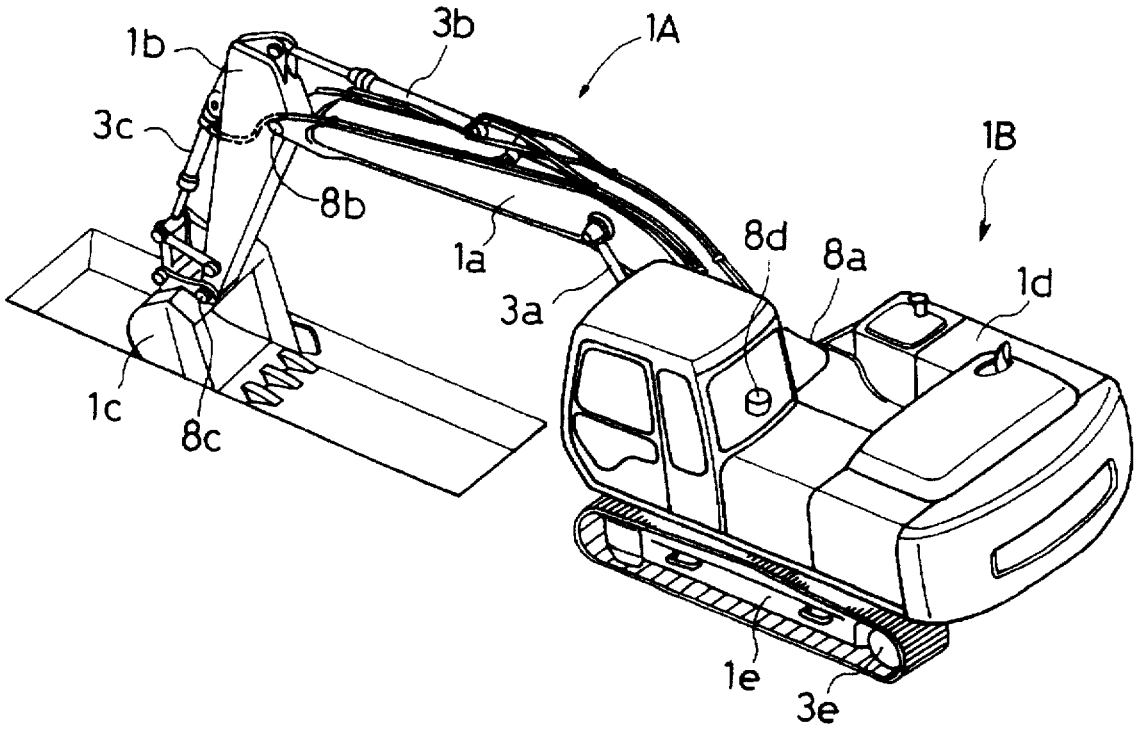
FIG. 2 is a view showing an appearance of a hydraulic excavator to which the present invention is applied, and a shape of a set region around the excavator.

Also, as shown in FIG. 2, the hydraulic excavator is made up by a multi-articulated front attachment or device 1A comprising a boom 1*a*, an arm 1*b* and a bucket 1*c* which are each rotatable in the vertical direction, and a body 1B comprising an upper structure 1*d* and an undercarriage 1*e*, the boom 1*a* of the front attachment 1A having its base end supported to a front portion of the upper structure 1*d*. The boom 1*a*, the arm 1*b*, the bucket 1*c*, the upper structure 1*d* and the undercarriage 1*e* serve as members driven respectively by the boom cylinder 3*a*, the arm cylinder 3*b*, the bucket cylinder 3*c*, the swing motor 3*d* and the left and right track motors 3*e*, 3*f*. The operations of these driven members are instructed from the control lever units 204*a* to 204*f*.

The control lever units 204*a* to 204*f* are each of electric lever type generating an electric signal as a control signal when manipulated. Each of the control lever units 204*a* to 204*f* comprises a control lever 240 manipulated by the operator, and a signal generator 241 for detecting the amount and the direction by and in which the control lever 240 is manipulated, and then generating an electric signal in accordance with the detected information. The electric signals generated by the respective signal generators 241 are input to a control unit 209. Based on the input electric signals, the control unit 209 outputs electric signals to proportional solenoid valves 210*a*, 210*b*; 211*a*, 211*b*; 212*a*, 212*b*; 213*a*, 213*b*; 214*a*, 214*b*; 215*a*, 215*b*. For simplicity of the drawing, the proportional solenoid valves 213*a*, 213*b*; 214*a*, 214*b*; 215*a*, 215*b* are shown together in the form of one block. The proportional solenoid valves 210*a* to 215*b* produce pilot pressures in accordance with the respective electric signals from the control unit 209. The proportional solenoid valves 210*a* to 215*b* have primary ports connected to a pilot hydraulic source 243 and secondary ports connected respectively to hydraulic driving sectors 50*a*, 50*b*; 51*a*, 51*b*; 52*a*, 52*b*; 53*a*, 53*b*; 54*a*, 54*b*; 55*a*, 55*b* of the corresponding flow control valves through pilot lines 244*a*, 244*b*; 245*a*, 245*b*; 246*a*, 246*b*; 247*a*, 247*b*; 248*a*, 248*b*; 249*a*, 249*b*. The pilot pressures produced by the proportional solenoid valves 210*a* to 215*b* are output therefrom as control signals for the corresponding flow control valves.

The flow control valves 5*a* to 5*f* are each a flow control valve of center bypass type. Center bypass passages of the flow control valves are connected in series by a center bypass line 242. The center bypass line 242 is connected at its upstream side to the hydraulic pump 2 through a supply line 243, and at its downstream side to a reservoir.

Figure 3:
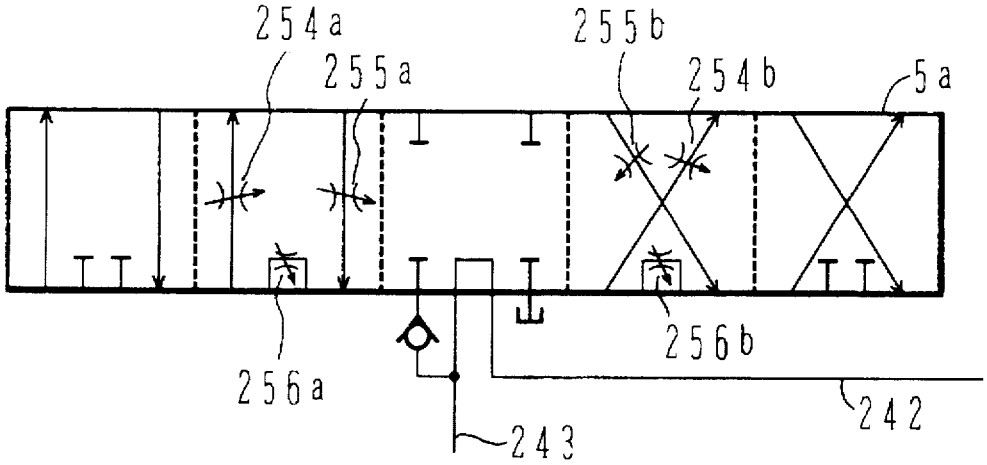
FIG. 3 is a view showing a transient position of a flow control valve of center bypass type.
Figure 4:
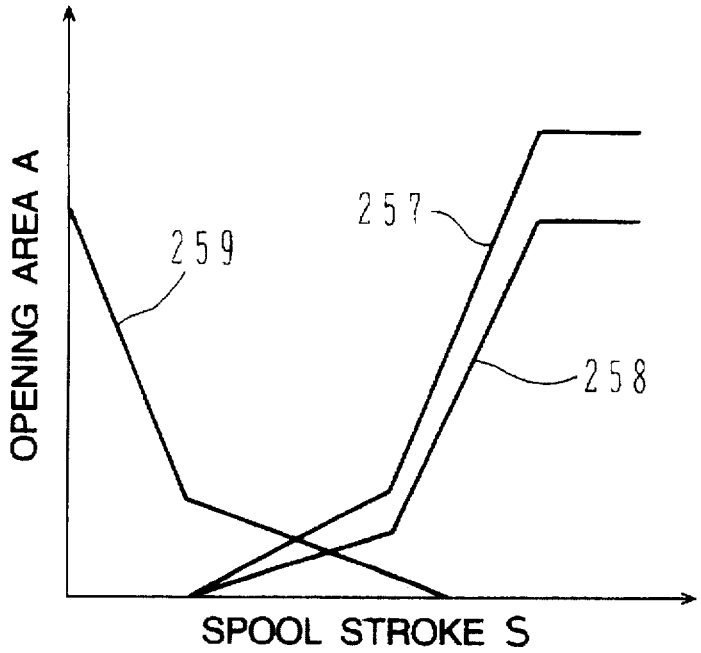
FIG. 4 is a graph showing opening characteristics of the flow control valve of center bypass type.

As will be seen from FIG. 3 which shows the flow control valve 5*a* as a representative, each of the flow control valves 5*a* to 5*f* has meter-in variable throttles 254*a*, 254*b* (hereinafter represented by 254) and meter-out variable throttles 255*a*, 255*b* (hereinafter represented by 255) formed therein, and also includes bleed-off variable throttles 256*a*, 256*b* (hereinafter represented by 256) provided in the center bypass passages. FIG. 4 shows the relationship between a spool stroke S of the flow control valve and an opening area A of each of the meter-in variable throttle 254, the meter-out variable throttle 255 and the bleed-off variable throttle 256. More specifically, reference numerals 257, 258 in FIG. 4 represent opening area characteristics of the meter-in variable throttle 254 and the meter-out variable throttle 255, and reference numeral 259 represents an opening area characteristic of the bleed-off variable throttle 256. The meter-in variable throttle 254 and the meter-out variable throttle 255 are fully closed when the spool stroke is 0 (i.e., when the flow control valve is in its neutral position), and their opening areas are increased as the spool stroke increases. On the other hand, the bleed-off variable throttle 256 is fully opened when the spool stroke is 0 and its opening area is reduced as the spool stroke increases.

In the thus-constructed flow control valve of center bypass type, therefore, when it is in the neutral position, the meter-in variable throttle 254 and the meter-out variable throttle 255 are fully closed, but the bleed-off variable throttle 256 is fully opened so that the hydraulic fluid from the hydraulic pump 2 is drained to the reservoir through the center bypass line 242. The delivery pressure of the hydraulic pump 2 at this time is at a minimum level. When the control lever unit is manipulated from the above condition so as to increase the spool stroke S, the opening areas A of the meter-in variable throttle 254 and the meter-out variable throttle 255 are increased, but the opening area of the bleed-off variable throttle 256 is reduced, thereby raising the delivery pressure of the hydraulic pump 2 correspondingly. When the delivery pressure of the hydraulic pump 2 becomes higher than the load pressure of the boom cylinder 3*a*, for example, the hydraulic fluid from the hydraulic pump 2 starts flowing into the hydraulic actuator, and the flow rate at which the hydraulic fluid is drained to the reservoir through the center bypass line 242 from the hydraulic pump 2 begins to reduce. Accordingly, the actuator is supplied with the hydraulic fluid at the flow rate resulted by subtracting the flow rate drained through the center bypass line from the pump delivery rate. This supply flow rate is increased with an increase in the spool stroke S and is maximized when the opening area A of the meter-in variable throttle 254 reaches a maximum value.

Figure 5:
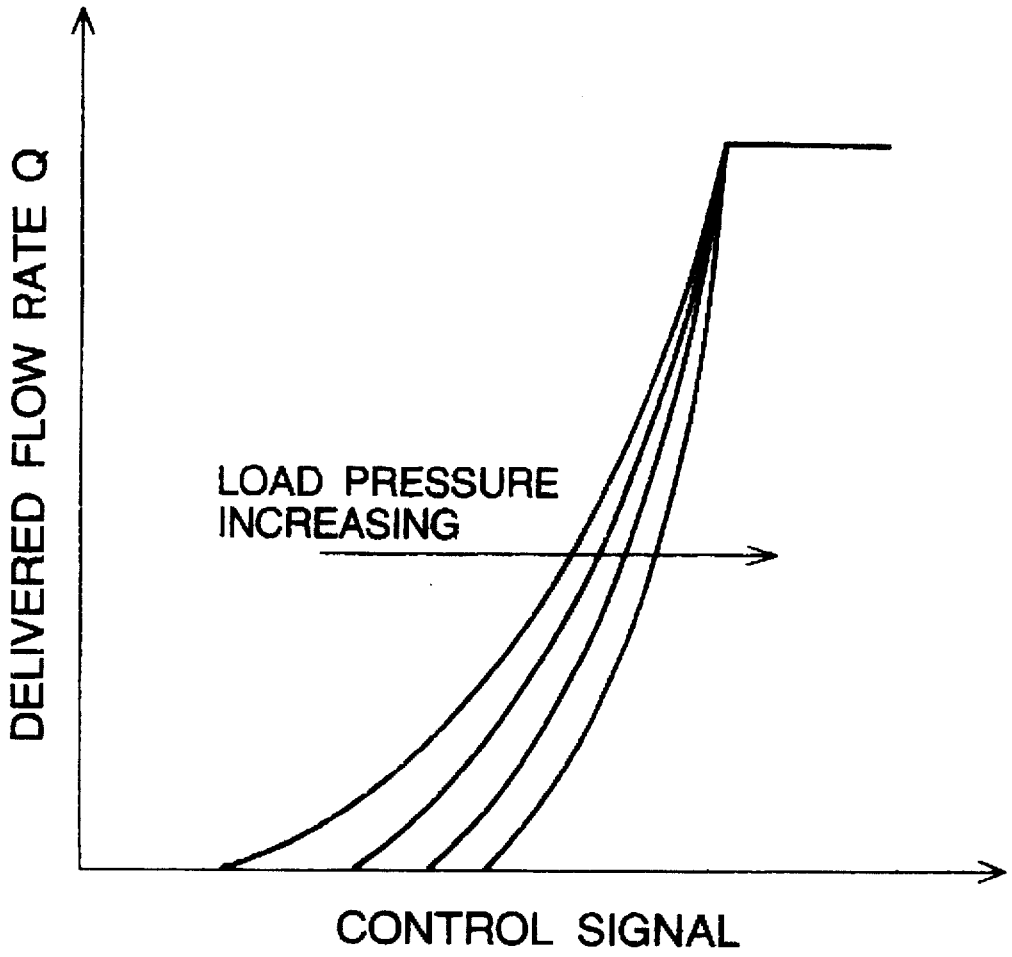
FIG. 5 is a graph showing flow rate characteristics of the flow control valve of center bypass type.

FIG. 5 shows flow rate characteristics (metering characteristics) of the flow control valve which operates as explained above. The horizontal axis represents a magnitude of the control signal (i.e., the pilot pressure). When the control signal increases and exceeds a certain value, the pump delivery pressure becomes higher than the load pressure and the hydraulic fluid starts flowing into the actuator at the flow rate that is increased with an increase in the magnitude of the control signal, as mentioned above. Also, as the load pressure of the actuator increases, the magnitude of the control signal (i.e., the spool stroke) at which the pump delivery pressure exceeds the load pressure is shifted to the larger side, and hence the magnitude of the control signal allowing the hydraulic fluid to start flowing into the actuator is increased correspondingly. Further, as the load pressure of the actuator increases, the flow rate supplied to the actuator (i.e., the flow rate delivered through the flow control valve) is reduced When the opening area of the meter-in variable throttle is equal to or smaller than its maximum value. Thus, since the flow rate characteristics of the flow control valves 5*a* to 5*f* are changed depending on respective load pressures, these flow rate characteristics will be referred to as "flow rate load characteristics" below in this specification.

A region limiting excavation control system of this embodiment is mounted on the hydraulic excavator constructed as explained above. The control system comprises a setter 7 for providing an instruction to set an excavation region where a predetermined location of the front attachment, e.g., the end of the bucket 1*c*, is movable, depending on the scheduled work beforehand, angle sensors 8*a*, 8*b*, 8*c* disposed respectively at pivotal points of the boom 1*a*, the arm 1*b* and the bucket 1*c* for detecting respective rotational angles thereof as status variables with regard to the position and posture of the front attachment 1A, an inclination angle sensor 8*d* for detecting an inclination angle 8 of the body 1B in the forth and back direction, pressure sensors 270*a*, 270*b*; 271*a*, 271*b* connected to respective actuator lines of the boom cylinder 3*a* and the arm cylinder 3*b* for detecting their pilot pressures, and a control unit 209 for receiving a set signal from the setter 7, detection signals from the angle sensors 8*a*, 8*b*, 8*c* and the inclination angle sensor 8*d*, the control signals (electric signals) from the control lever units 204*a*, 204*b*, and detection signals from the pressure sensors 270*a*, 270*b*; 271*a*, 271*b*, setting the excavation region where the end of the bucket 1*c* is movable, and outputting electric signals to the proportional solenoid valves 210*a* to 211*b* to perform excavation control within the limited region.

The setter 7 comprises manipulation means, such as a switch, disposed on a control panel or grip for outputting a set signal to the control unit 209 to instruct setting of the excavation region. Other suitable aid means such as a display may be provided on the control panel. The setting of the excavation region may be instructed by any of other suitable methods such as using IC cards, bar codes, laser, and wireless communication.

Figure 6:
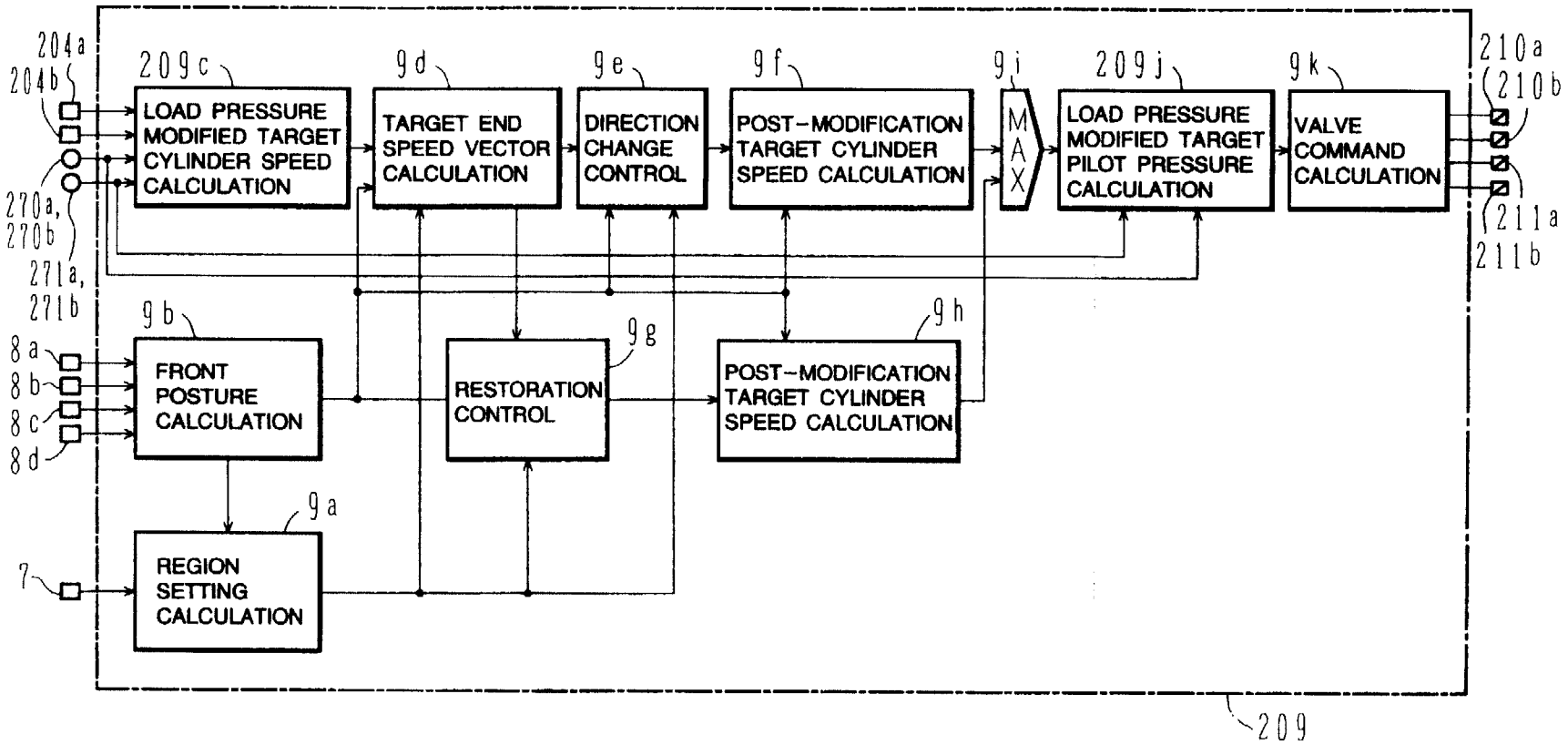
FIG. 6 is a functional block diagram showing control functions of a control unit.

Control functions of the control unit 209 which concern the region limiting excavation control system are shown in FIG. 6. The control unit 209 includes functional portions consisted of a region setting calculator 9*a*, a front posture calculator 9*b*, a load pressure modified target cylinder speed calculator 209*c*, a target end speed vector calculator 9*d*, a direction change controller 9*e*, a post-modification target cylinder speed calculator 9*f*, a restoration control calculator 9*g*, a post-modification target cylinder speed calculator 9*h*, a target cylinder speed selector 9*i*, a load pressure modified target pilot pressure calculator 209*j*, and a valve command calculator 9*k*.

The region setting calculator 9*a* executes calculation for setting of the excavation region where the end of the bucket 1*c* is movable, in accordance with an instruction from the setter 7. One example of a manner of setting the excavation region will be described with reference to FIG. 7. Note that, in this embodiment, the excavation region is set in a vertical plane.

Figure 7:
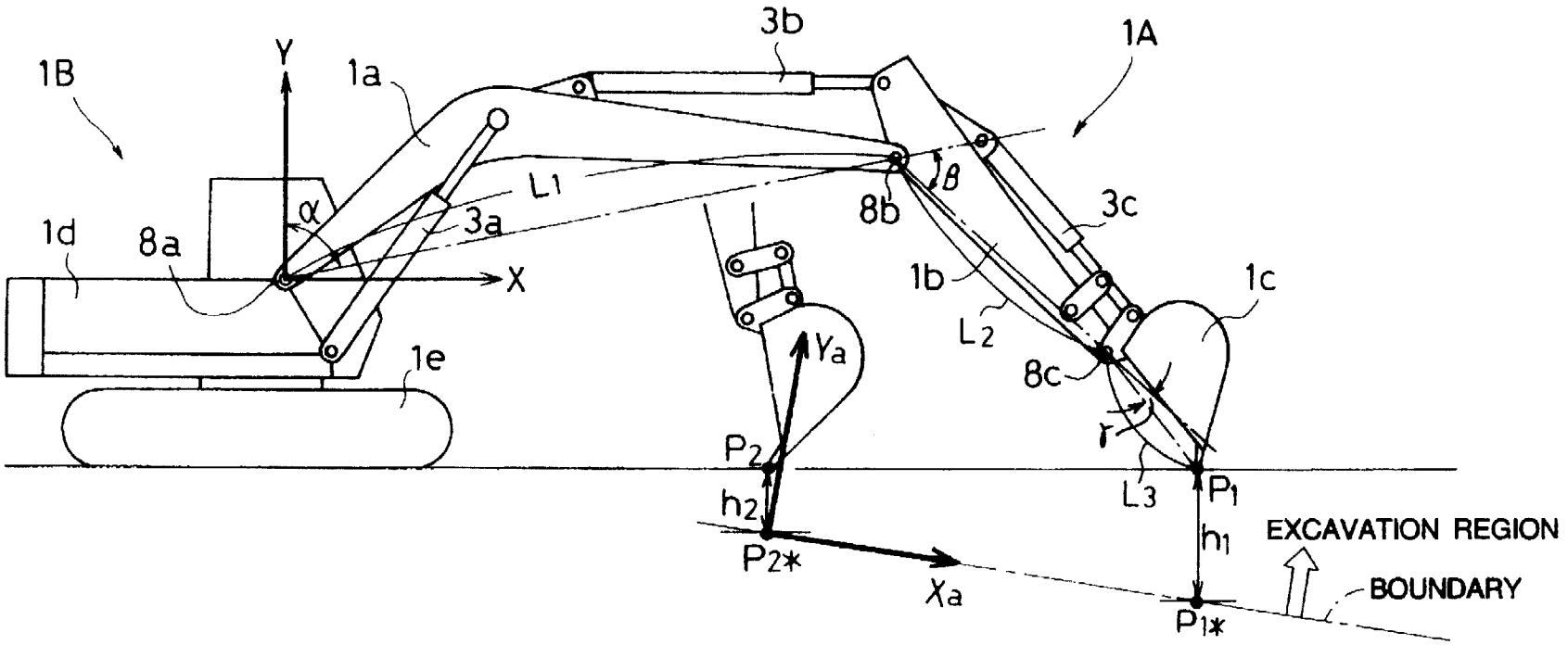
FIG. 7 is a view showing a coordinate system for use in region limiting excavation control of this embodiment and a method of setting a region.

In FIG. 7, after the end of the bucket 1*c* has been moved to the position of a point P1 upon the operator manipulating the front attachment, the end position of the bucket 1*c* at that time is calculated in response to an instruction from the setter 7, and the setter 7 is then operated to input a depth h1 from that position to designate a point P1* on the boundary of the excavation region to be set in terms of depth. Subsequently, after moving the end of the bucket 1*c* to the position of a point P2, in a like manner to the above, the end position of the bucket 1*c* at that time is calculated in response to an instruction from the setter 7, and the setter 7 is then operated to input a depth h2 from that position to designate a point P2* on the boundary of the excavation region to be set in terms of depth. Then, a formula expressing the straight line connecting the two points P1* and P2* is calculated and set as the boundary of the excavation region.

In the above process, the positions of the two points P1, P2 are calculated by the front posture calculator 9*b*, and the region setting calculator 9*a* calculates the formula of the straight line from information on the positions of those two points.

The control unit 209 includes a memory storing various dimensions of the front attachment 1A and the body 1B, and the front posture calculator 9*b* calculates the positions of the two points P1, P2 based on the stored data and values of rotational angles $\alpha$, $\beta$, $\gamma$ detected respectively by the angle sensors 8*a*, 8*b*, 8*c*. At this time, the positions of the two points P1, P2 are determined, by way of example, as coordinate values (X1, Y1), (X2, Y2) on the XY-coordinate system with the origin defined as the pivotal point of the boom 1*a*. The XY-coordinate system is an orthogonal coordinate system fixed on the body 1B and is assumed to exist in a vertical plane. Given that the distance between the pivotal point of the boom 1*a* and the pivotal point of the arm 1*b* is L1, the distance between the pivotal point of the arm 1*b* and the pivotal point of the bucket 1*c* is L2, and the distance between the pivotal point of the bucket 1*c* and the end of the bucket 1*c* is L3, the coordinate values (X1, Y1), (X2, Y2) on the XY-coordinate system are determined from the rotational angles α, β, γ by using formulae below.

$$X=L1\ \sin\alpha+L2\ \sin(\alpha+\beta)+L3\ \sin(\alpha+\beta+\gamma)$$

$$Y=L1\ \cos\alpha+L2\ \cos(\alpha+\beta)+L3\ \cos(\alpha+\beta+\gamma)$$

The region setting calculator 9*a* determines the coordinate values of the two points P1*, P2* on the boundary of the excavation region by calculating the Y-coordinate values as follows.

$$Y1^*=Y1-h1$$

$$Y2^*=Y2-h2$$

The formula expressing the straight line connecting the two points P1* and P2* is calculated from the following equation.

$$Y=(Y2^*-Y1^*)X/(X2-X1)+(X2Y1^*-X1Y2^*)/(X2-X1)$$

Then, an orthogonal coordinate system having the origin on the above straight line and one axis defined by the above straight line, for example, an XaYa-coordinate system with the origin defined as the point P2*, is set and coordinate transform data from the XY-coordinate system into the XaYa-coordinate system is determined.

Figure 8:
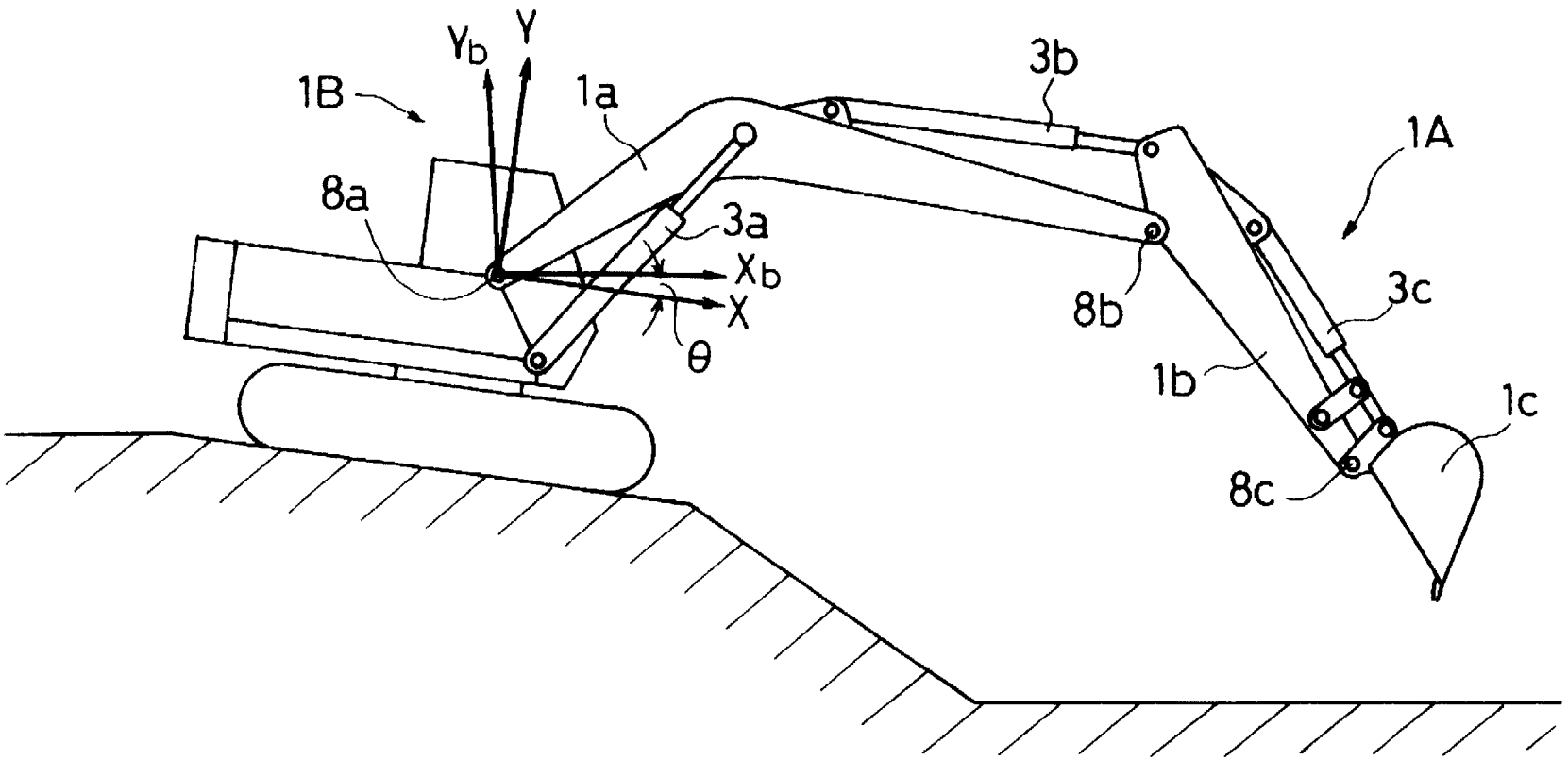
FIG. 8 is a view for explaining a method of modifying an inclination angle.

When the body 1B is inclined as shown in FIG. 8, the relative positional relationship between the bucket end and the ground is changed and the setting of the excavation region cannot correctly be performed. In this embodiment, therefore, the inclination angle θ of the body 1B is detected by the inclination angle sensor 8*d* and a detected value of the angle θ is input to the front posture calculator 9*b* which calculates the end position of the bucket in an XbYb-coordinate which is provided by rotating the XY-coordinate system through the angle 8. This enables the excavation region to be correctly set even if the body 1B is inclined. Note that the inclination angle sensor is not always required when work is started after correcting an inclination of the body if the body is inclined, or when excavation is performed in the work site where the body will not incline.

Figure 9:
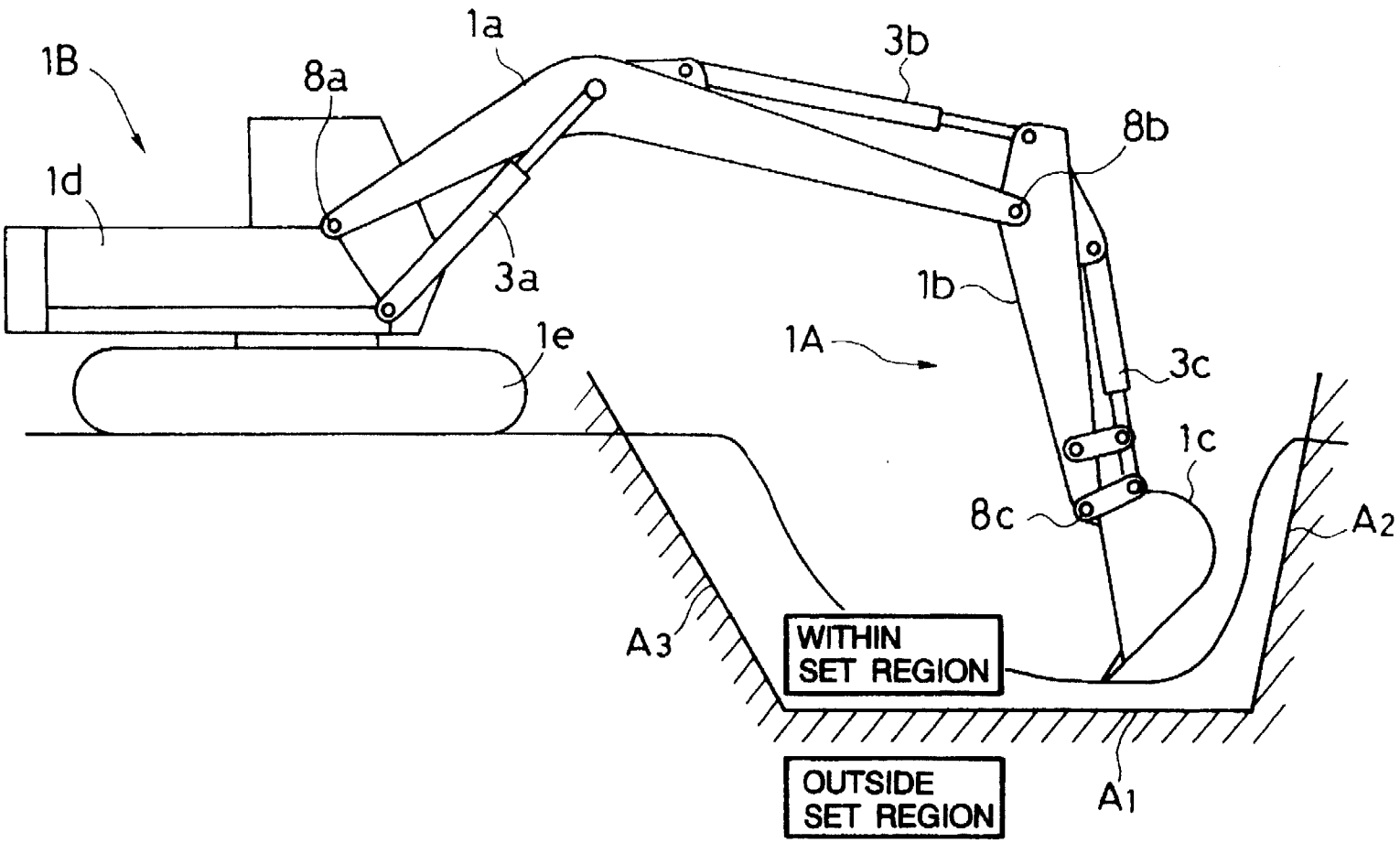
FIG. 9 is a view showing one example of the region set in this embodiment.

While the boundary of the excavation region is set by a single straight line in the above example, the excavation region having any desired shape in a vertical plane can be set by combining a plurality of straight lines with each other. FIG. 9 shows one example of the latter case in which the excavation region is set by using three straight lines A1, A2 and A3. In this case, the boundary of the excavation region can be set by carrying out the same operation and calculation as mentioned above for each of the straight lines A1, A2 and A3.

As explained above, the front posture calculator 9*b* calculates the position of a predetermined location of the front attachment 1A as the coordinate values on the XY-coordinate system based on the various dimensions of the front attachment 1A and the body 1B which are stored in the memory of the control unit 209, as well as the values of the rotational angles α, β, γ detected respectively by the angle sensors 8*a*, 8*b*, 8*c*.

Figure 10:
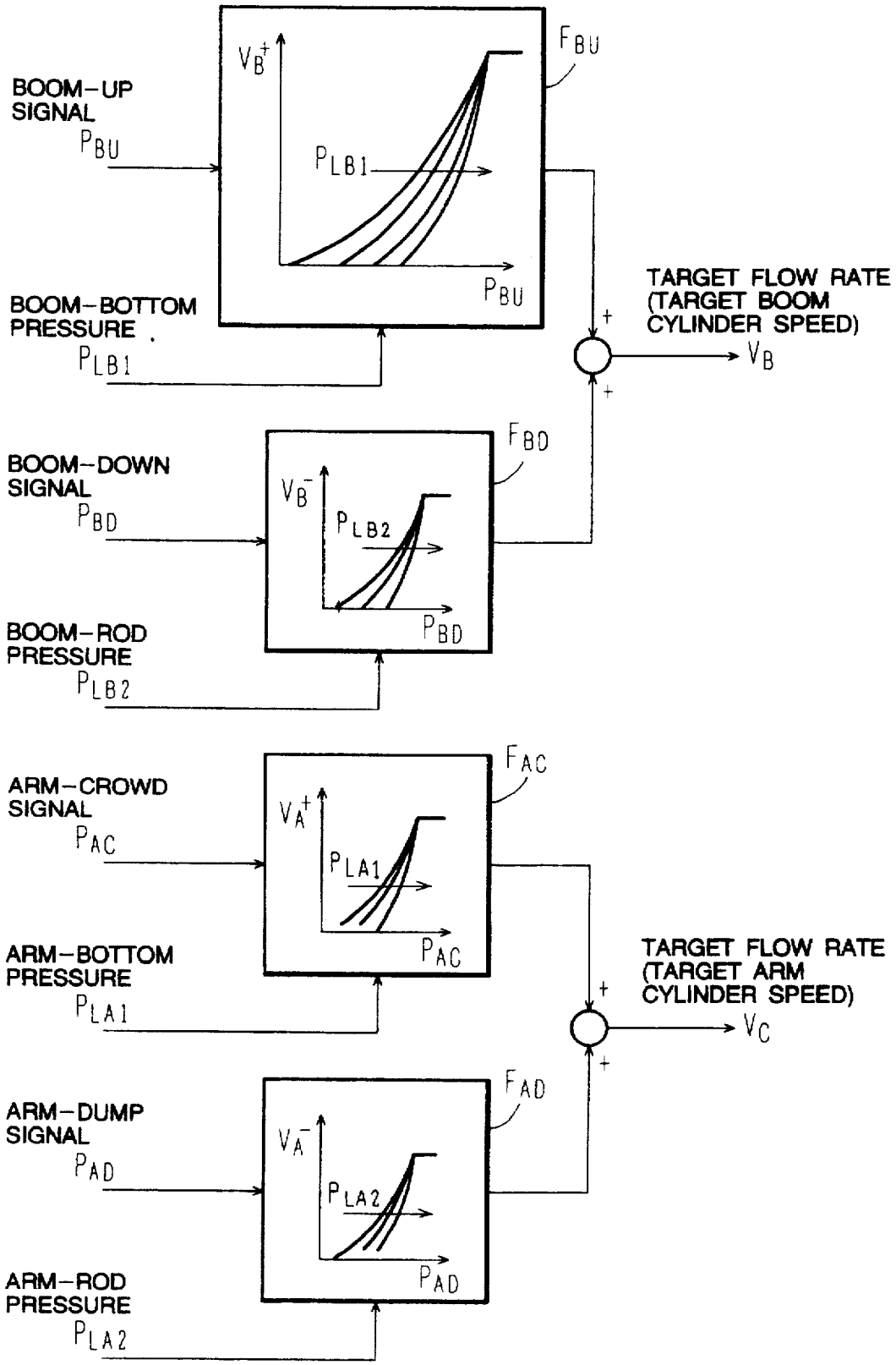
FIG. 10 is a diagram showing the relationships among control signals, load pressures and flow rates delivered through the flow control valves in a target cylinder speed calculator.

The load pressure modified target cylinder speed calculator 209*c* receives the electric signals (control signals) from the control lever units 204*a*, 204*b* and the load pressures detected by the pressure sensors 270*a* to 271*b*, determines input target flow rates delivered through the flow control valves 5*a*, 5*b* which have been modified depending on the load pressures (hereinafter referred to simply as target delivered flow rates), and then calculates target speeds of the boom cylinder 3*a* and the arm cylinder 3*b* from the determined target delivered flow rates. The memory of the control unit 209 stores relationships FBU, FBD, FAC, FAD among control signals PBU, PBD, PAC, PAD, load pressures PLB1, PLB2, PLA1, PLA2, and target delivered flow rates VB, VA through the flow control valves 5*a*, 5*b* as shown in FIG. 10. The target cylinder speed calculator 209*c* determines the target delivered flow rates through the flow control valves 5*a*, 5*b* by utilizing the above stored relationships.

Here, the relationships shown in FIG. 10 are based on the flow rate load characteristics of the flow control valves 5*a*, 5*b* as shown in FIG. 5. More specifically, the relationship FBU corresponds to the flow rate load characteristic resulted when the flow control valve 5*a* is moved in the boom-up direction, the relationship FBD corresponds to the flow rate load characteristic resulted when the flow control valve 5*a* is moved in the boom-down direction, the relationship FAC corresponds to the flow rate load characteristic resulted when the flow control valve 5*b* is moved in the arm-crowd direction, and the relationship FAD corresponds to the flow rate load characteristic resulted when the flow control valve 5*b* is moved in the arm-dump direction. By so setting the relationships FBU, FBD, FAC, FAD in match with the flow rate load characteristics in consideration of that the flow rate characteristics of the flow control valves 5*a*, 5*b* are changed with the associated load pressures, the flow rate characteristics are modified so as to yield values of the target flow rates (i.e., the target cylinder speeds) corresponding to manipulation of the control lever units 204*a*, 204*b* regardless of change in the load pressures of the boom cylinder 3*a* and the arm cylinder 3*b*. As a result, the correct target cylinder speeds can be calculated.

As an alternative, the target cylinder speeds may be determined from the control signals directly by storing the previously calculated relationships among the control signals, the load pressures and the target cylinder speeds in the memory of the control unit 209.

The target end speed vector calculator 9*d* determines an input target speed vector Vc at the end of the bucket 1*c* (hereinafter referred to simply as a target speed vector Vc) from the position of the bucket end determined by the front posture calculator 9*b*, the target cylinder speed determined by the target cylinder speed calculator 209*c*, and the various dimensions, such as L1, L2 and L3, stored in the memory of the control unit 209. At this time, the target speed vector Vc is first determined as values on the XY-coordinate system shown in FIG. 7, and then determined as values on the XaYa-coordinate system by converting the values on the XY- coordinate system into the values on the XaYa-coordinate system using the transform data from the XY-coordinate system to the XaYa-coordinate system previously determined by the region setting calculator 9*a*. Now, an Xa-coordinate value Vcx of the target speed vector Vc on the XaYa-coordinate system represents a vector component in the direction parallel to the boundary of the set region, and a Ya-coordinate value Vcy of the target speed vector Vc on the XaYa-coordinate system represents a vector component in the direction vertical to the boundary of the set region.

When the end of the bucket 1*c* is positioned within the set region near the boundary thereof and the target speed vector Vc has a component in the direction toward the boundary of the set region, the direction change controller 9e modifies the vertical vector component such that it is gradually reduced as the bucket end comes closer to the boundary of the set region. In other words, to the vector component Vcy in the vertical direction, a vector (reversed vector) being smaller than the component Vcy and orienting away from the set region is added.

Figure 11:
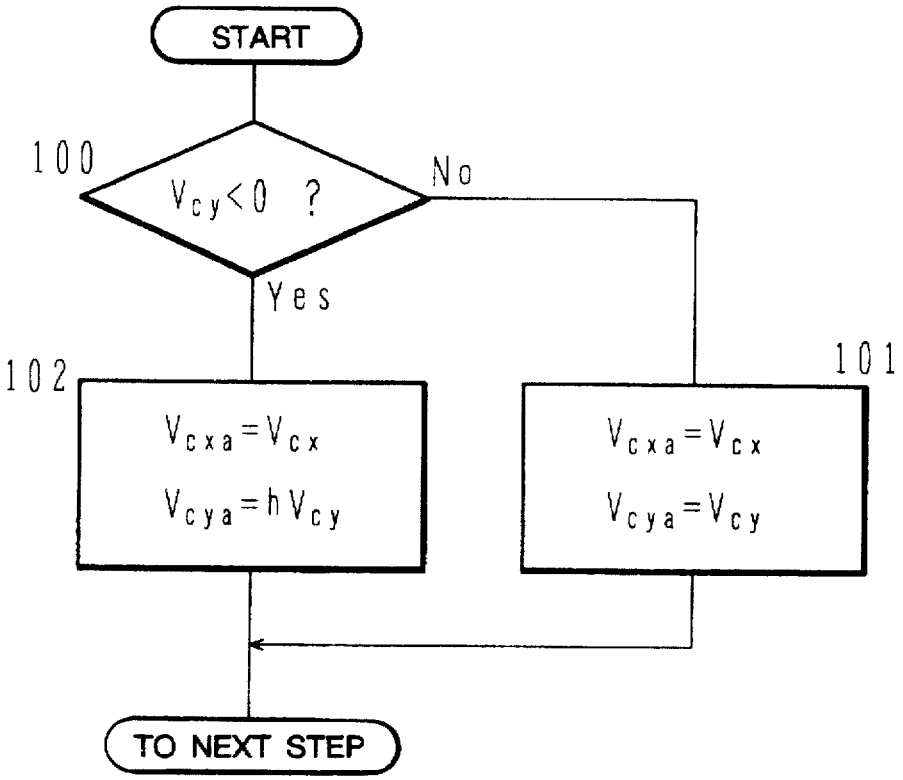
FIG. 11 is a flowchart showing processing procedures executed in a direction change controller.

FIG. 11 is a flowchart showing control procedures executed in the direction change controller 9e. First, in step 100, whether the component of the target speed vector Vc vertical to the boundary of the set region, i.e., the Ya-coordinate value Vcy on the XaYa-coordinate system, is positive or negative is determined. If the Ya-coordinate value Vcy is positive, this means the speed vector being oriented such that the bucket end moves away from the boundary of the set region. Therefore, the control procedure goes to step 101 where the Xa-coordinate value Vcx and the Ya-coordinate value Vcy of the target speed vector Vc are set, as they are, to vector components Vcxa, Vcya after modification. If the Ya-coordinate value Vcy is negative, this means the speed vector being oriented such that the bucket end moves closer to the boundary of the set region. Therefore, the control procedure goes to step 102 where, for the direction change control, the Xa-coordinate value Vcx of the target speed vector Vc is set, as it is, to the vector component Vcxa after modification, and a value obtained by multiplying the Ya-coordinate value Vcy by a coefficient h is set to the vector component Vcya after modification.

Figure 12:
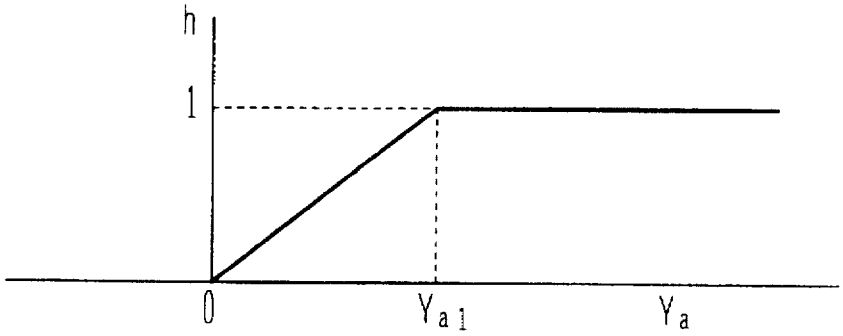
FIG. 12 is a graph showing the relationship between a distance Ya from the end of a bucket to the boundary of the set region and a coefficient h in the direction change controller.

Here, as shown in FIG. 12, the coefficient h is a value which takes 1 when the distance Ya between the end of the bucket 1c and the boundary of the set region is larger than a preset value Ya1, which is gradually reduced from 1 as the distance Ya decreases when the distance Ya is smaller than the preset value Ya1, and which takes 0 when the distance Ya becomes zero, i.e., when the bucket end reaches the boundary of the set region. Such a relationship between h and Ya is stored in the memory of the control unit 209.

In the direction change controller 9e, the end position of the bucket 1c determined by the front posture calculator 9b is converted into coordinate values on the XaYa-coordinate system by using the transform data from the XY-coordinate system to the XaYa-coordinate system previously calculated by the region setting calculator 9a. Then, the distance Ya between the end of the bucket 1c and the boundary of the set region is determined from the converted Ya-coordinate value, and the coefficient h is determined from the distance Ya based on the relationship of FIG. 12.

By modifying the vertical vector component Vcy of the target speed vector Vc as described above, the vertical vector component Vcy is reduced such that the amount of reduction in the vertical vector component Vcy is increased as the distance Ya decreases. Thus, the target speed vector Vc is modified into a target speed vector Vca. Here, the range of the distance Ya1 from the boundary of the set region Can be called a direction change region or a deceleration region.

Figure 13:
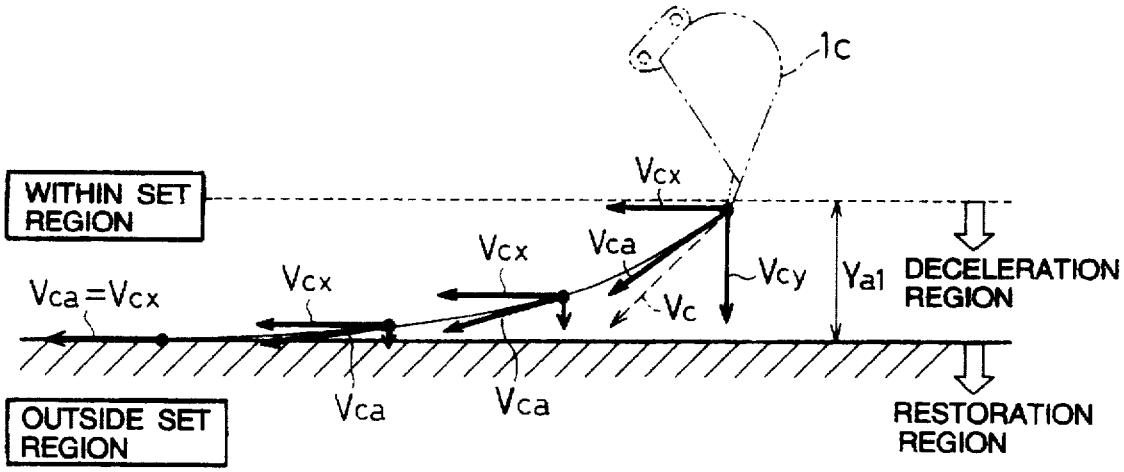
FIG. 13 is a diagram showing one example of a path along which the bucket end is moved when direction change control is performed as per calculation.

FIG. 13 shows one example of a path along which the end of the bucket 1c is moved when the direction change control is performed as per the above-described target speed vector Vca after modification. Given that the target speed vector Vc is oriented downward obliquely and constant, its parallel component Vcx remains the same and its vertical component Vcy is gradually reduced as the end of the bucket 1c comes closer to the boundary of the set region (i.e., as the distance Ya decreases). Because the target speed vector Vca after modification is a resultant of both the parallel and vertical components, the path is in the form of a curved line which is curved to come closer to a parallel line while approaching the boundary of the set region, as shown in FIG. 13. Also, given that h=0 holds at Ya=0, the target speed vector Vca after modification on the boundary of the set region coincides with the parallel component Vcx.

Figure 14:
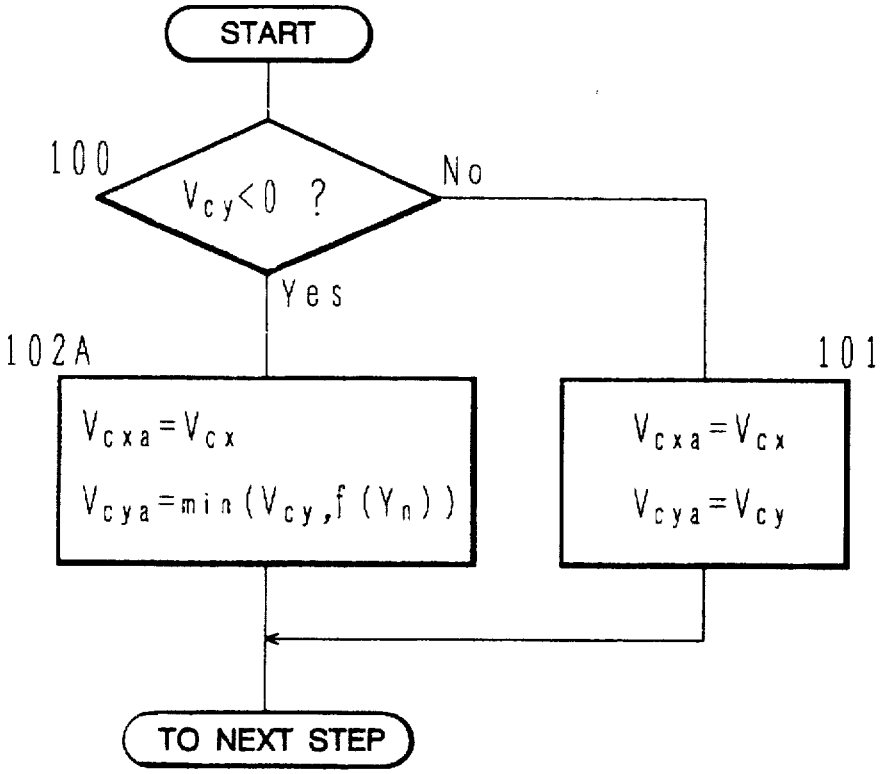
FIG. 14 is a flowchart showing other processing procedures executed in the direction change controller.
Figure 15:
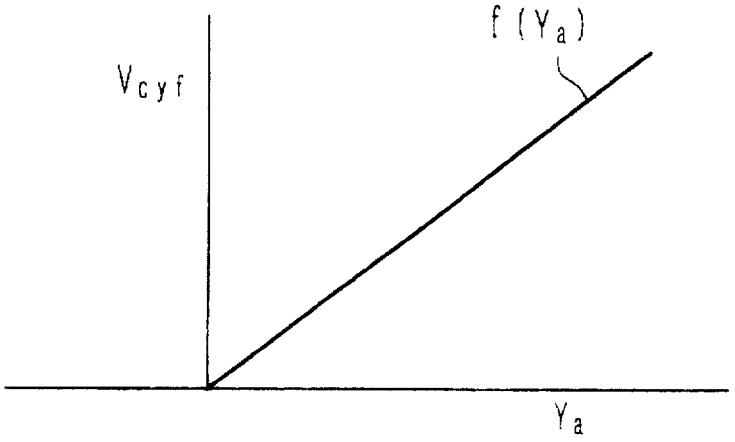
FIG. 15 is a graph showing the relationship between the distance Ya and a function Vcyf in the direction change controller.

FIG. 14 is a flowchart showing another example of control procedures executed in the direction change controller 9e. In this example, if the component Vcy of the target speed vector Vc vertical to the boundary of the set region (i.e., the Ya-coordinate value of the target speed vector Vc) is determined to be negative in step 100, the control procedure Goes to step 102A where a decelerated Ya-coordinate value Vcyf corresponding to the distance Ya between the end of the bucket 1c and the boundary of the set region is determined from the functional relationship of Vcyf=f(Ya), shown in FIG. 15, stored in the memory of the control unit 209 and smaller one of the Ya-coordinate values Vcyf and Vcy is then set to the vector component Vcya after modification. This provides an advantage that when the end of the bucket 1c is slowly moved, the bucket speed is not reduced any longer even if the bucket end comes closer to the boundary of the set region, allowing the operator to carry out the operation as per manipulation of the control lever.

In spite of that the vertical component of the target speed vector at the bucket end is reduced as explained above, it is very difficult to make the vertical vector component zero at the vertical distance Ya=0 due to variations caused by manufacture tolerances of the flow control valves and other hydraulic equipment, causing the bucket end to often Go out of the set region. In this embodiment, however, since restoration control described later is also effected, the bucket end is controlled to operate almost on the boundary of the set region. Because of the restoration control being thus effected in a combined manner, the relationships shown in FIGS. 12 and 15 may be set such that the coefficient h or the Ya-coordinate value Vchf after deceleration may be somewhat above zero at the vertical distance Ya=0.

While the horizontal component (Xa-coordinate value) of the target speed vector remains the same in the above-explained control, it is not always required to remain the same. The horizontal component may be increased to speed up the bucket end, or decreased to speed down the bucket end. The latter case will be described below as another embodiment.

The post-modification target cylinder speed calculator 9f calculates target cylinder speeds of the boom cylinder 3a and the arm cylinder 3b from the target speed vector after modification determined by the direction change controller 9e. This process is a reversal of the calculation executed by the target end speed vector calculator 9d.

When the direction change control (deceleration control) is performed in step 102 or 102A in the flowchart of FIG. 11 or 14, the directions in which the boom cylinder and the arm cylinder are required to be operated to achieve the direction change control are selected and the target cylinder speeds in the selected operating directions are calculated. A description will now be made of, by way of example, the case of crowding the arm with an intention of digging the ground toward the body (i.e., the arm-crowd operation) and the case of operating the bucket end in the direction to push it by the combined operation of boom-down and arm-dump (i.e., the arm-dump combined operation).

In the arm-crowd operation, the vertical component Vcy of the target speed vector Vc can be reduced in three ways below;

(1) raising the boom 1a;

(2) decelerating the operating to crowd the arm 1b; and (3) combining the methods (1) and (2).

In the combined method (3), proportions of the two methods are dependent on the posture of the front attachment, the horizontal vector component, etc. at that time. Anyway, the proportions are determined in accordance with the control software. Since this embodiment includes the restoration control as well, the method (1) or (3) including raise-up of the boom 1*a* is preferable. Taking into account smoothness of the operation, the method (3) is most preferable.

In the arm-dump combined operation, when the arm is dumped from the position near the body (nearby position), the target vector in the direction of going out of the set region is given. To reduce the vertical component Vcy of the target speed vector Vc, therefore, the arm-dumping is required to be slowed down by switching the boom operation mode from boom-down to boom-up. The combination of boom-up and arm-dump is also determined in accordance with the control software.

In the restoration controller 9*g*, when the end of the bucket 1*c* goes out of the set region, the target speed vector is modified depending on the distance from the boundary of the set region so that the bucket end is returned to the set region. In other words, to the vector component Vcy in the vertical direction, a vector (reversed vector) being larger than the component Vcy and orienting toward the set region is added.

Figure 16:
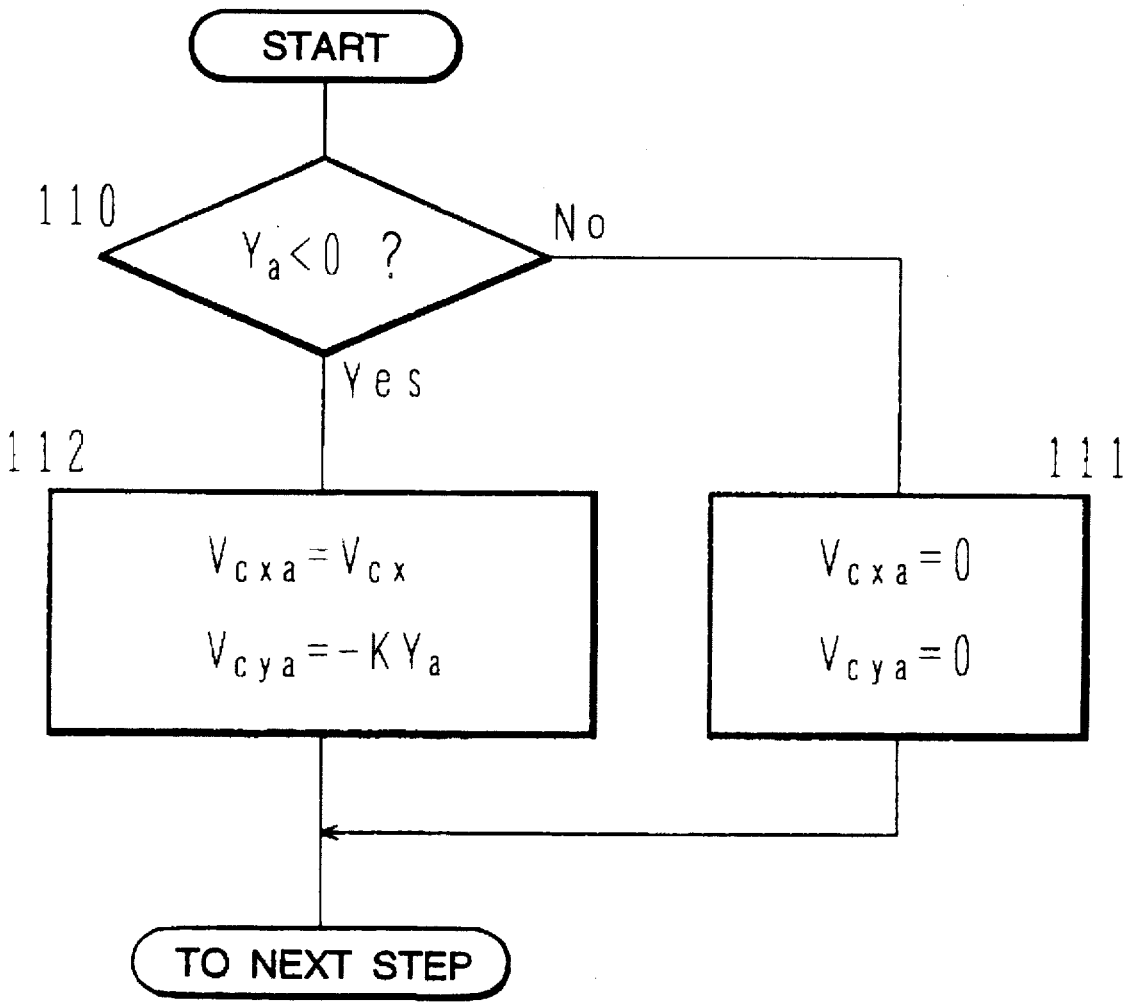
FIG. 16 is a flowchart showing processing procedures executed in a restoration controller.

FIG. 16 is a flowchart showing control procedures executed in the restoration controller 9*g*. First, in step 110, whether the distance Ya between the end of the bucket 1*c* and the boundary of the set region is positive or negative is determined. Here, the distance Ya is determined by converting the position of the front end determined by the front posture calculator 9*b* into coordinate values on the XaYa-coordinate system by using the transform data from the XY-coordinate system to the XaYa-coordinate system, as described above, and then extracting the converted Ya-coordinate value. If the distance Ya is positive, this means that the bucket end is still within the set region. Therefore, the control procedure goes to step 111 where the Xa-coordinate value Vcx and the Ya-coordinate value Vcy of the target speed vector Vc are each set to 0 to carry out the direction change control explained above with priority. If the distance Ya is negative, this means that the bucket end has moved out of the boundary of the set region. Therefore, the control procedure goes to step 112 where, for the restoration control, the Xa-coordinate value Vcx of the target speed vector Vc is set, as it is, to the vector component Vcxa after modification, and as to the Ya-coordinate value Vcya, a value obtained by multiplying the distance Ya between the bucket end and the boundary of the set region by a coefficient—K is set to the vector component Vcya after modification. The coefficient K is an arbitrary value determined from the viewpoint of control characteristics, and—KYa represents a speed vector in the reversed direction which becomes smaller as the distance Ya decreases. Incidentally, K may be a function of which value is reduced as the distance Ya decreases. In this case,—KYa is reduced at a greater rate as the distance Ya decreases.

By modifying the vertical vector component Vcy of the target speed vector Vc as described above, the target speed vector Vc is modified into a target speed vector Vca so that the vertical vector component Vcy is reduced as the distance Ya decreases.

Figure 17:
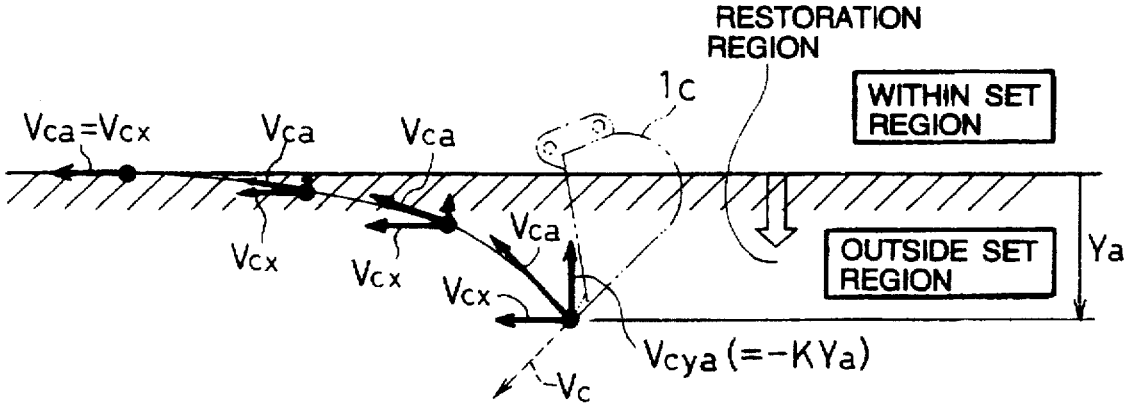
FIG. 17 is a diagram showing one example of a path along which the bucket end is moved when restoration control is performed as per calculation.

FIG. 17 shows one example of a path along which the end of the bucket 1*c* is moved when the restoration control is performed as per the above-described target speed vector Vca after modification. Given that the target speed vector Vc is oriented downward obliquely and constant, its parallel component Vcx remains the same and its vertical component is gradually reduced as the end of the bucket 1*c* comes closer to the boundary of the set region (i.e., as the distance Ya decreases), for a restoration vector Vcya (=–KYa) is proportional to the distance Ya. Because the target speed vector Vca after modification is a resultant of both the parallel and vertical components, the path is in the form of a curved line which is curved to come closer to a parallel line while approaching the boundary of the set region, as shown in FIG. 17.

Thus, since the end of the bucket 1*c* is controlled to return to the set region by the restoration controller a restoration region is defined outside the set region. In the restoration control, the movement of the end of the bucket 1*c* toward the boundary of the set region is also slowed down and, eventually, the direction in which the end of the bucket 1*c* is moving is converted into the direction along the boundary of the set region. In this meaning, the restoration control can also be called direction change control.

The post-modification target cylinder speed calculator 9*h* calculates target cylinder speeds of the boom cylinder 3*a* and the arm cylinder 3*b* from the target speed vector after modification determined by the restoration controller 9*g*. This process is a reversal of the calculation executed by the target end speed vector calculator 9*d*.

When the restoration control is performed in step 112 in the flowchart of FIG. 16, the directions in which the boom cylinder and the arm cylinder are required to be operated to achieve the restoration control are selected and the target cylinder speeds in the selected operating directions are calculated. Since the bucket end is returned to the set region by raising the boom 1*a* in the restoration control, the direction of raising the boom 1*a* is always included. The combination of boom-up and any other mode is also determined in accordance with the control software.

The target cylinder speed selector 9*i* selects the larger one (maximum value) of a value of the target cylinder speed determined by the target cylinder speed calculator 9*f* for the direction change control and a value of the target cylinder speed determined by the target cylinder speed calculator 9*h* for the restoration control, and then sets the selected value as a target cylinder speed to be output.

Here, when the distance Ya between the bucket end and the boundary of the set region is positive, the target speed vector components are both set to 0 in step 111 of FIG. 16 and the target speed vector components set in step 101 or 102 of FIG. 11 always have greater values. Accordingly, the target cylinder speed determined by the target cylinder speed calculator 9*f* for the direction change control is selected. When the distance Ya is negative and the vertical component Vcy of the target speed vector is negative, the vertical component Vcya after modification is set to 0 in step 102 of FIG. 11 because of h=0 and the vertical component set in step 112 of FIG. 16 always has a greater value. Accordingly, the target cylinder speed determined by the target cylinder speed calculator 9*h* for the restoration control is selected. When the distance Ya is negative and the vertical component Vcy of the target speed vector is positive, the target cylinder speed determined by the target cylinder speed calculator of 9*f* or 9*h* is selected depending on which one of the vertical component Vcy of the target speed vector Vc set in step 101 of FIG. 11 and the vertical component KYa in step 112 of FIG. 16 is larger. Incidentally, as an alternative, the selector 9*i* may be arranged to take the sum of both the components, for example, rather than selecting the maximum value.

The load pressure modified target pilot pressure calculator 209*j* receives both the respective target cylinder speeds to be output which are selected by the target cylinder speed selector 9i and the load pressures detected by the pressure sensors 270a to 271b, and then calculates target pilot pressures (target operation command value) modified depending on the load pressures. This process is a reversal of the calculation executed by the load pressure modified target cylinder speed calculator 209c.

Figure 18:
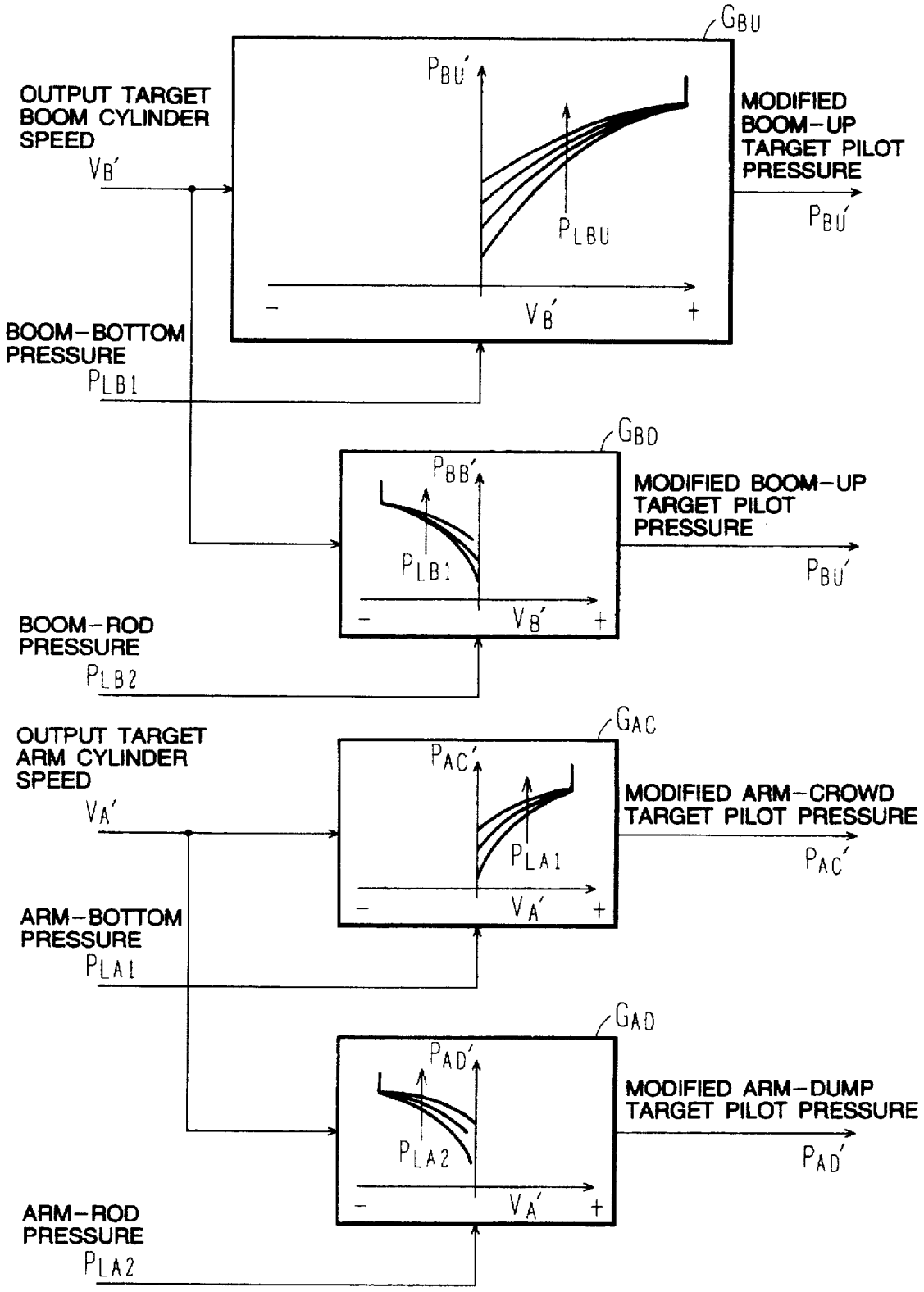
FIG. 18 is a diagram showing the relationships among output cylinder speeds, load pressures and target pilot pressures in a target pilot pressure calculator.

More specifically, the memory of the control unit 209 stores relationships GBU, GBD, GAC, GAD among output target cylinder speeds VB', VA', the load pressures PLB1, PLB2, PLA1, PLA2, and target pilot pressures P'BU, P'BD, P'AC, P'AD as shown in FIG. 18. The target pilot pressure calculator 209j determines the target pilot pressures for driving the flow control valves 5a, 5b by utilizing the above stored relationships.

Here, the relationships shown in FIG. 18 are obtained from the relationships shown in FIG. 10 by replacing the control signals PBU, PBD, PAC, PAD with the target pilot pressures P'BU, P'BD, P'AC, P'AD and the target delivered flow rates VB, VA with the output target cylinder speeds VB', VA', and are also based on the flow rate load characteristics of the flow control valves 5a, 5b as shown in FIG. 5. By so setting the relationships GBU, GBD, GAC, GAD in match with the flow rate load characteristics in consideration of that the flow rate characteristics of the flow control valves 5a, 5b are changed with the associated load pressures, the pilot pressures (i.e., the control signals) are modified so that the tip end of the front attachment may be moved in accordance with the output target speed vector regardless of change in the load pressures of the boom cylinder 3a and the arm cylinder 3b.

The valve command calculator 9k calculates, from the target pilot pressures calculated by the target pilot pressure calculator 209j, command values for the proportional solenoid valves 210a, 210b, 211a, 211b necessary to establish those target pilot pressures. The command values are amplified by amplifiers and output as electric signals to the proportional solenoid valves.

When the direction change control (deceleration control) in step 102 or 102A in the flowchart of FIG. 11 or 14 is carried out, the control in the arm-crowd operation includes boom-up motion and deceleration of arm-crowd motion as explained above. The boom-up motion is effected by outputting an electric signal to the proportional solenoid valve 210a associated with the boom-up pilot line 244a, and the deceleration of arm-crowd motion is effected by outputting an electric signal to the proportional solenoid valve 211a disposed in the arm-crowd side pilot line 245a. In the case of the arm-dump combined operation, the boom operation mode is switched from boom-down to boom-up and the arm-dump motion is slowed down. The switching from boom-down to boom-up is effected by nulling the electric signal output to the proportional solenoid valve 210b disposed in the boom-down pilot line 244b, and outputting an electric signal to the proportional solenoid valve 210a. The deceleration of the arm-dump motion is effected by outputting an electric signal to the proportional solenoid valve 211b disposed in the arm-dump side pilot line 245b. In other cases, output to the proportional solenoid valves 210a, 210b, 211a, 211b are electric signals corresponding respectively to the pilot pressures in the associated pilot lines so that those pilot pressures are delivered as they are.

In the above arrangement, the control lever units 204a to 204f make up a plurality of manipulation means for instructing operations of the plurality of driven members, i.e., the boom 1a, the arm 1b, the bucket 1c, the upper structure 1d and the undercarriage 1e. The setter 7 and the front region setting calculator 9a make up region setting means for setting a region where the front attachment 1a is movable. The angle sensors 8a to 8c and the inclination angle sensor 8d make up first detecting means for detecting status variables with regard to the position and posture of the front attachment 1A. The pressure sensors 270a to 271b make up second detecting means for detecting the load pressures of the boom cylinder 3a and the arm cylinder 3b as particular front actuators associated with the boom 1a and the arm 1b which are particular front members. The front posture calculator 9b constitutes first calculating means for calculating the position and posture of the front-attachment 1A based on signals from the first detecting means.

The target cylinder speed calculator 209c, the target end speed vector calculator 9d, the direction change controller 9e, the restoration controller 9g, the post-modification target cylinder speed calculators 9f, 9h, the target cylinder speed selector 9i, the load pressure modified target pilot pressure calculator 209j, the valve command calculator 9k, and the proportional solenoid valves 210a to 211b make up signal modifying means for, based on the control signals from those ones 204a, 204b of the plurality of manipulation means 4a to 4f which are associated with the front attachment 1A and the values calculated by the first calculating means, carrying out calculation of the target speed vector Vca of the front attachment 1A, modifying the control signals from the manipulation means 204a, 204b associated with the front attachment 1A so that, when the front attachment 1A is within the set region near the boundary of the set region, the front attachment 1A is allowed to move in the direction along the boundary of the set region and a moving speed of the front attachment 1A in the direction toward the boundary of the set region is reduced, and modifying the control signals from the manipulation means 204a, 204b associated with the front attachment 1A so that, when the front attachment 1A is outside the set region, the front attachment 1A is returned to the set region. The load pressure modified target pilot pressure calculator 209j constitutes output modifying means for, based on signals from the second detecting means (the pressure sensors 270a to 271b), further modifying, of the control signals modified by the above signal modifying means, the control signals from the manipulation means 204a, 204b which are associated with the particular front members (the boom 1a and the arm 1b) for any case of modification of the control signals so that the front attachment 1A is moved as per the target speed vector Vca regardless of change in the load pressures of the particular front actuators (the boom cylinder 3a and the arm cylinder 3b).

The target cylinder speed calculator 209c and the target end speed vector calculator 9d make up second calculating means for calculating the input target speed vector Vc of the front attachment 1A based on the control signals from the manipulation means 204a, 204b associated with the front attachment 1A. The direction change controller 9e and the restoration controller 9g make up third calculating means for modifying the input target speed vector Vc (in the direction change controller 9e) so that, when the front attachment 1A is within the set region near the boundary of the set region, the vector component of the input target speed vector Vc in the direction toward the boundary of the set region is reduced, and modifying the input target speed vector Vc (in the restoration controller 9g) so that, when the front attachment 1A is outside the set region near, the front attachment is returned to the set region. The post- modification target cylinder speed calculators 9f, 9h, the target cylinder speed selector 9i, the target pilot pressure calculator 209j, the valve command calculator 9k, and the proportional solenoid valves 210a to 211b make up valve control means for driving the associated hydraulic control valves 5a, 5b so that the front attachment 1A is moved in accordance with the target speed vector Vca modified by the third calculating means. The output modifying means (the target pilot pressure calculator 209j) is constituted as part of the valve control means.

The post-modification target cylinder speed calculator 9f, the target cylinder speed selector 9i, and the target pilot pressure calculator 209j make up fourth calculating means for calculating the target operation command values of the associated hydraulic control valves 5a, 5b based on the target speed vector Vc modified by the third calculating means (the direction change controller 9f and the restoration controller 9g). The valve command calculator 9k and the proportional solenoid valves 210a to 211b make up output means for producing the control signals for the associated hydraulic control valves 5a, 5b based on the target operation command values calculated by the fourth calculating means. Here, the target pilot pressure calculator 209j of the fourth calculating means calculates the target operation command values for the associated hydraulic control valves 5a, 5b from the target actuator speeds and the load pressures detected by the second detecting means (the pressure sensors 270a to 271b) in accordance with the preset characteristics. Also, the aforesaid output modifying means is constituted as part of the fourth calculating means and, in the calculation of the target operation command values, modifies those ones of the target operation command values which are associated with the particular front actuators 3a, 3b, depending on the load pressures detected by the second detecting means (the pressure sensors 270a to 271b).

Further, the load pressure modified target cylinder speed calculator 209c constitutes input modifying means for, based on the signals from the second detecting means (the pressure sensors 270a to 271b), modifying the target speed vector Vc calculated by the aforesaid second calculating means (the target cylinder speed calculator 209c and the target end speed vector calculator 9d) so that the speed vector corresponding to the control signals from the manipulation means 204a, 204b is obtained regardless of change in the load pressures of the particular front actuators (the boom cylinder 3a and the arm cylinder 3b).

In the second calculating means, the target cylinder speed calculator 209c constitutes fifth calculating means for calculating the input target actuator speeds based on the control signals from the manipulation means 204a, 204b associated with the front attachment 1A, and the target end speed vector calculator 9d constitutes sixth calculating means for calculating the input target speed vector Vc of the front attachment 1A from the input target actuator speeds calculated by the fifth calculating means. Here, the target cylinder speed calculator 209 of the fifth calculating means calculates the input target actuator speeds from the control signals from the manipulation means 204a, 204b associated with the front attachment 1A and the load pressures detected by the second detecting means (the pressure sensors 270a to 271b) in accordance with the preset characteristics. Also, the aforesaid input modifying means is constituted as part of the fifth calculating means and, in the calculation of the input target actuator speeds, modifies the input target actuator speeds of the particular front actuators 3a, 3b depending on the load pressures detected by the second detecting means (the pressure sensors 270a to 271b).

Operation of this embodiment having the above-explained arrangement will be described below. The following description will be made, by way of example, of the case of crowding the arm with an intention of digging the ground toward the body (i.e., the arm-crowd operation) and the case of operating the bucket end in the direction to push it by the combined operation of boom-down and arm-dump (i.e., the arm-dump combined operation).

When the arm is crowded with an intention of digging the ground toward the body, the end of the bucket 1c gradually comes closer to the boundary of the set region. When the distance between the bucket end and the boundary of the set region becomes smaller than Ya1, the direction change controller 9e makes modification to reduce the vector component of the target speed vector Vc at the bucket end in the direction toward the boundary of the set region (i.e., the vector component vertical to the boundary), thereby carrying out the direction change control (deceleration control) for the bucket end. At this time, if the software is designed to perform the direction change control in a combination of boom-up motion and deceleration of arm-crowd motion in the post-modification target cylinder speed calculators 9f, the calculator 9f calculates a cylinder speed in the direction of extending the boom cylinder 3a and a cylinder speed in the direction of extending the arm cylinder 3b, the target pilot pressure calculator 209j calculates a target pilot pressure in the boom-up side pilot line 244a and a target pilot pressure in the arm-crowd side pilot line 245a, and the valve command calculator 9k outputs electric signals to the proportional solenoid valves 210a, 211a. Therefore, the proportional solenoid valves 210a, 211a output control pressures corresponding to the target pilot pressure calculated by the calculator 209j and the control pressure is introduced to the boom-up side hydraulic driving sector 50a of the boom flow control valve 5a and the arm-crowd side hydraulic driving sector 51a of the arm flow control valve 5b. With such operations of the proportional solenoid Valves 210a, 211a, the movement of the bucket end in the direction vertical to the boundary of the set region is controlled to speed down, but the speed component in the direction along the boundary of the set region is not reduced. Accordingly, the end of the bucket 1c can be moved along the boundary of the set region as shown in FIG. 13. It is thus possible to efficiently perform excavation while limiting a region where the end of the bucket 1c is movable.

If the movement of the front attachment 1A is fast when the end of the bucket is controlled to slowed down near the boundary of the set region within it as described above, the end of the bucket 1c may go out of the set region to some extent due to a delay in control response and the inertia of the front attachment 1A. In this embodiment, when such an event occurs, the restoration controller 9g implements the restoration control by modifying the target speed vector Vc so that the end of the bucket 1c is returned to the set region. At this time, if the software is designed to perform the restoration control in a combination of boom-up motion and deceleration of arm-crowd motion in the post-modification target cylinder speed calculator 9h, as with the above case of the direction change control, the calculator 9h calculates a cylinder speed in the direction of extending the boom cylinder 3a and a cylinder speed in the direction of extending the arm cylinder 3b, the target pilot pressure calculator 209j calculates a target pilot pressure in the boom-up side pilot line 244a and a target pilot pressure in the arm-crowd side pilot line 245a, and the valve command calculator 9k outputs electric signals to the proportional solenoid valves 210a, 211a. As a result, the proportional solenoid valves 210a, 211a are operated as explained above so that the bucket end is controlled to quickly return to the set region.

allowing excavation to be carried out on the boundary of the set region. Therefore, even if the front attachment 1A is moved fast, the bucket end can be moved along the boundary of the set region and the excavation within a limited region can precisely be implemented.

Also, in the restoration control, since the movement of the bucket end is already slowed down through the direction change control as explained above, the amount by which the bucket end goes out of the set region is so reduced that the shock occurred upon returning to the set region is greatly alleviated. Therefore, even if the front attachment 1A is moved fast, the end of the bucket 1*c* can smoothly be moved along the boundary of the set region and the excavation within a limited region can smoothly be implemented.

Further, in the restoration control of this embodiment, since the vector component of the target speed vector Vc vertical to the boundary of the set region is modified so as to leave the speed component in the direction along the boundary of the set region, the end of the bucket 1*c* can also smoothly be moved outside the set region along the boundary of the set region. In this connection, since the vector component in the direction toward the boundary of the set region is modified to become smaller as the distance Ya between the end of the bucket 1*c* and the boundary of the set region decreases, the path along which the bucket end is mowed under the restoration control based on the target speed vector Vca after modification is in the form of a curved line which is curved to come closer to a parallel line while approaching the boundary of the set region, as shown in FIG. 17. This enables the bucket end to be returned to the set region in a smoother manner.

When digging work is performed while moving the bucket end along a predetermined path, e.g., the boundary of the set region, it is usually required for the operator to control the movement of the bucket end by manipulating at least two control levers of the boom control lever unit 204*a* and the arm control lever unit 204*b*. In this embodiment, the operator may of course manipulate both the control levers of the boom and arm control lever units 204*a*, 204*b* simultaneously, but if the operator manipulates one arm control lever, the cylinder speeds of the hydraulic cylinders necessary for the direction change control or the restoration control are calculated by the calculator 9*f* or 9*h* as explained above, causing the bucket end to move along the boundary of the set region. Accordingly, the digging work along the boundary of the set region can be implemented by manipulating just one arm control lever.

During the digging work along the boundary of the set region, it is often required to manually raise the boom 1*a* in such an case as that a lot of earth has entered the bucket 1*c*, or there is an Obstacle in the movement path of the bucket end, or digging resistance is to be reduced because the front attachment has stalled due to large digging resistance. In that case, the boom can be raised by manipulating the boom control lever unit 204*a* in the boom-up direction as a pilot pressure is established in the boom-up side pilot line 244*a*.

When the arm is dumped from the position near the body (nearby position) in the combined operation of boom-down and arm-dump for moving the bucket end in the direction to put it, the target vector in the direction of going out of the set region is given. In this case, too, when the distance between the bucket end and the boundary of the set region becomes smaller than Ya1, the direction change controller 9*e*. makes modification of the target speed vector Vc in a like manner to the above for carrying out the direction change control (deceleration control) for the bucket end. At this time, if the software is designed to perform the direction change control in a combination of boom-up motion and deceleration of arm-dump motion in the post-modification target cylinder speed calculators 9*f*, the calculator 9*f* calculates a cylinder speed in the direction of extending the boom cylinder 3*a* and a cylinder speed in the direction of contracting the arm cylinder 3*b*, the target pilot pressure calculator 209*j* calculates a target pilot pressure in the boom-up side pilot line 244*a* and a target pilot pressure in the arm-dump side pilot line 245*b* while setting the target pilot pressure in the boom-down side pilot line 244*b* to 0, and the valve command calculator 9*k* turns off the output the proportional solenoid valve 210*b* and outputs electric signals to the proportional solenoid valves 210*a*, 211*b*. Therefore, the direction change control is performed as with the above case of the arm-crowd operation. It is thus possible to quickly move the end of the bucket 1*c* along the boundary of the set region and to efficiently perform excavation while limiting a region where the end of the bucket 1*c* is movable.

If the end of the bucket 1*c* may go out of the set region to some extent, the restoration controller 9*g* implements the restoration control by modifying the target speed vector Vc. At this time, if the software is designed to perform the restoration control in a combination of boom-up motion and deceleration of arm-dump motion in the post-modification target cylinder speed calculator 9*h*, as with the above case of the direction change control, the calculator 9*h* calculates a cylinder speed in the direction of extending the boom cylinder 3*a* and a cylinder speed in the direction of contracting the arm cylinder 3*b*, the target pilot pressure calculator 209*j* calculates a target pilot pressure in the boom-up side pilot line 244*a* and a target pilot pressure in the arm-dump side pilot line 245*b*, and the valve command calculator 9*k* outputs electric signals to the proportional solenoid valves 210*a*, 211*b*. As a result, the bucket end is controlled to quickly return to the set region, allowing excavation to be carried out on the boundary of the set region. As with the above case of the arm-crowd operation, therefore, even if the front attachment 1A is moved fast, the bucket end can smoothly be moved along the boundary of the set region and the excavation within a limited region can be implemented smoothly and precisely.

Further, if the control lever is manipulated to raise the boom during the control process, the boom can be moved up as with the above case of the arm-crowd operation.

When the movement of the front attachment 1A is controlled as stated above, the target pilot pressure calculator 209*j* calculates the target pilot pressures P'BU, P'BD, P'AC, P'AD from the output target cylinder speeds VB', VA' and the load pressures, taking into account change in the flow rate characteristics of the flow control valves 5*a*, 5*b* depending on change in the load pressures of the boom cylinder 3*a* and the arm cylinder 3*b*. Therefore, even if the flow rate characteristics of the flow control valves 5*a*, 5*b* are varied with change in the load pressures of the boom cylinder 3*a* and the arm cylinder 3*b*, the pilot pressures (the control signals) are modified correspondingly. This modification reduces the deviation between the calculated value of the target speed vector on the control basis and the actual movement, and prevents the actual end position of the bucket 1*c* from deviating from the calculated position on the control basis to a large extent. Accordingly, when digging work is implemented along the boundary of the set region, the work can be controlled with good accuracy in point of, e.g., enabling the end of the bucket 1*c* to be precisely moved along the boundary of the set region. Also, stable control is achieved because of yielding no large deviations in the control process.

Furthermore, the target cylinder speed calculator 209c calculates the target delivered flow rates through the flow control valves 5a, 5b (the target cylinder speeds) from the electric signals (the control signals) from the control lever units 204a, 204b and the load pressures, taking into account change in the flow rate characteristics of the flow control valves 5a, 5b depending on change in the load pressures of the boom cylinder 3a and the arm cylinder 3b. Therefore, even if the flow rate characteristics of the flow control valves 5a, 5b are varied with change in the load pressures of the boom cylinder 3a and the arm cylinder 3b, the target speed vector Vc calculated by the direction change controller 9e and the restoration controller 9g is modified correspondingly. With this modification, the deviation between the calculated value of the target speed vector on the control basis and the actual movement is also reduced in the above process, which is effective in further improving the control accuracy.

With this embodiment, as described above, when the end of the bucket 1c is away from the boundary of the set region, the target speed vector Vc is not modified and the work can be implemented in a normal manner. When the end of the bucket 1c comes closer to the boundary of the set region within it, the direction change control is performed so that the end of the bucket 1c can be moved along the boundary of the set region. It is therefore possible to efficiently perform excavation while limiting a region where the end of the bucket 1c is movable.

If the movement of the front attachment 1A is fast and the end of the bucket 1c goes out of the set region, since the restoration control is effected to control the end of the bucket 1c to quickly return to the set region, the bucket end can precisely be moved along the boundary of the set region and the excavation within a limited region can precisely be implemented.

Since the direction change control (deceleration control) is effected prior to entering the restoration control, the shock occurred upon returning to the set region is greatly alleviated. Therefore, even if the front attachment 1A is moved fast, the end of the bucket 1c can smoothly be moved along the boundary of the set region and the excavation within a limited region can smoothly be implemented.

Further, since the speed component in the direction along the boundary of the set region is not reduced in the restoration control, the end of the bucket 1c can also smoothly be moved outside the set region along the boundary of the set region. In addition, since the vector component in the direction toward the boundary of the set region is modified to become smaller as the distance Ya between the end of the bucket 1c and the boundary of the set region decreases, the bucket end can be returned to the set region in a smoother manner.

As a result of enabling the end of the bucket 1c to be smoothly moved along the boundary of the set region, by operating the bucket 1c to move toward the body, it is possible to implement the excavation as if the path control along the boundary of the set region is performed.

Moreover, the digging work along the boundary of the set region can be implemented by using just one arm control lever.

Additionally, even if the load pressures of the boom cylinder 3a and the arm cylinder 3b are changed during excavation within a limited region, the deviation between the calculated value of the target speed vector on the control basis and the actual mechanical movement is kept so small as to be able to perform control with good accuracy, and no significant deviations are produced in the control process, resulting in stable control.

Second Embodiment

Figure 19:
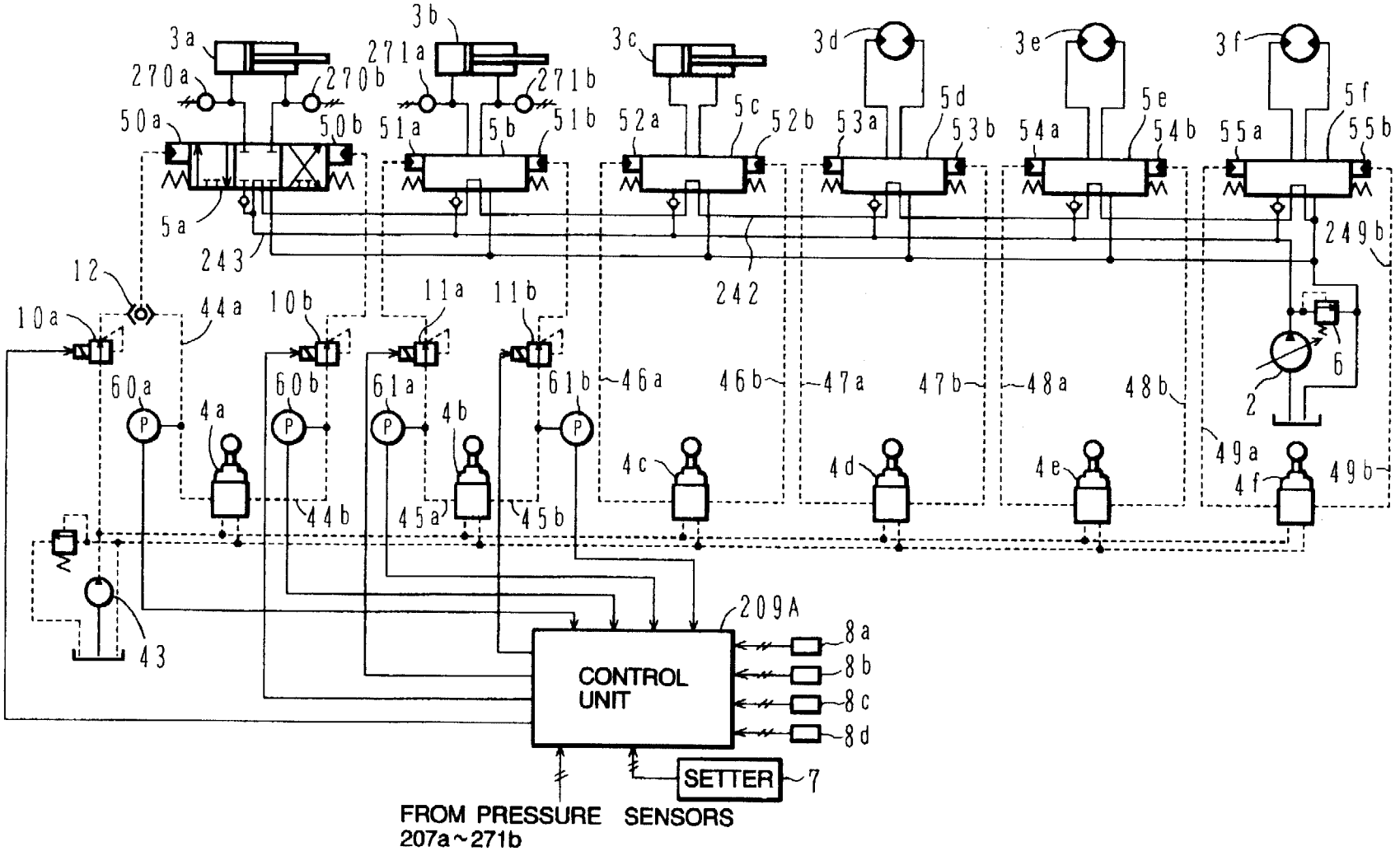
FIG. 19 is a diagram showing a region limiting excavation control system for a construction machine according to a second embodiment of the present invention, along with a hydraulic drive system.
Figure 20:
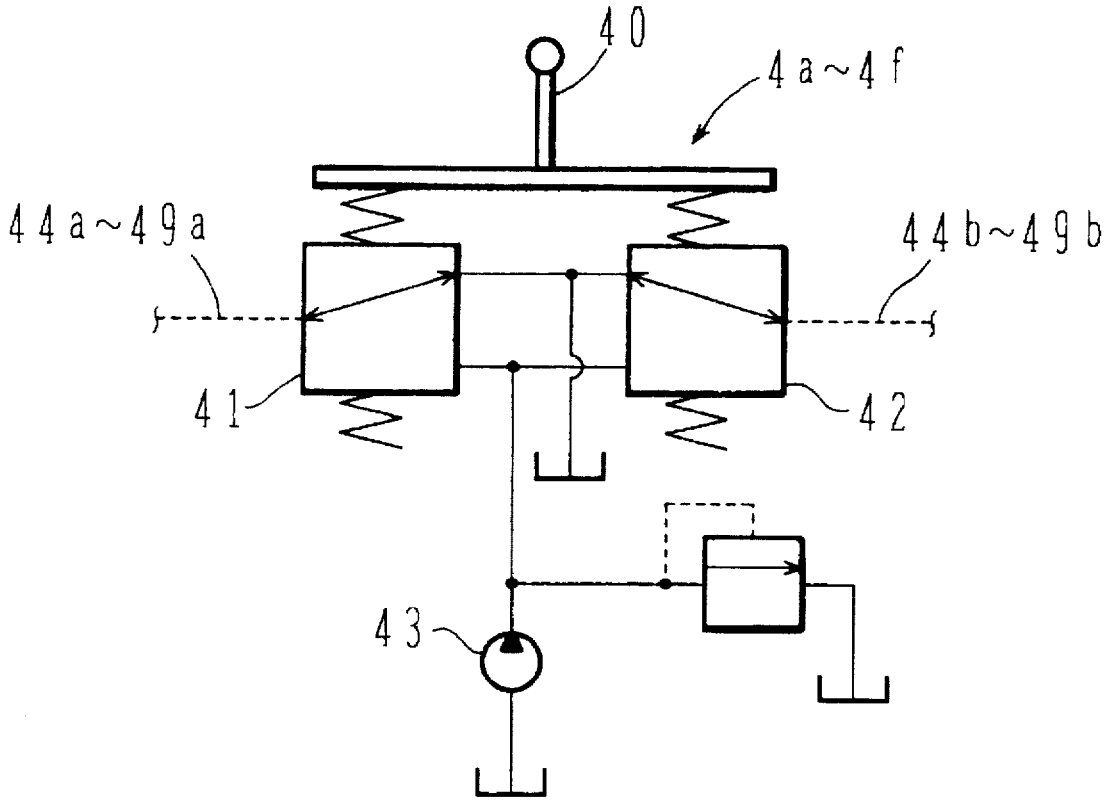
FIG. 20 is a view showing details of a control lever unit of hydraulic pilot type.
Figure 21:
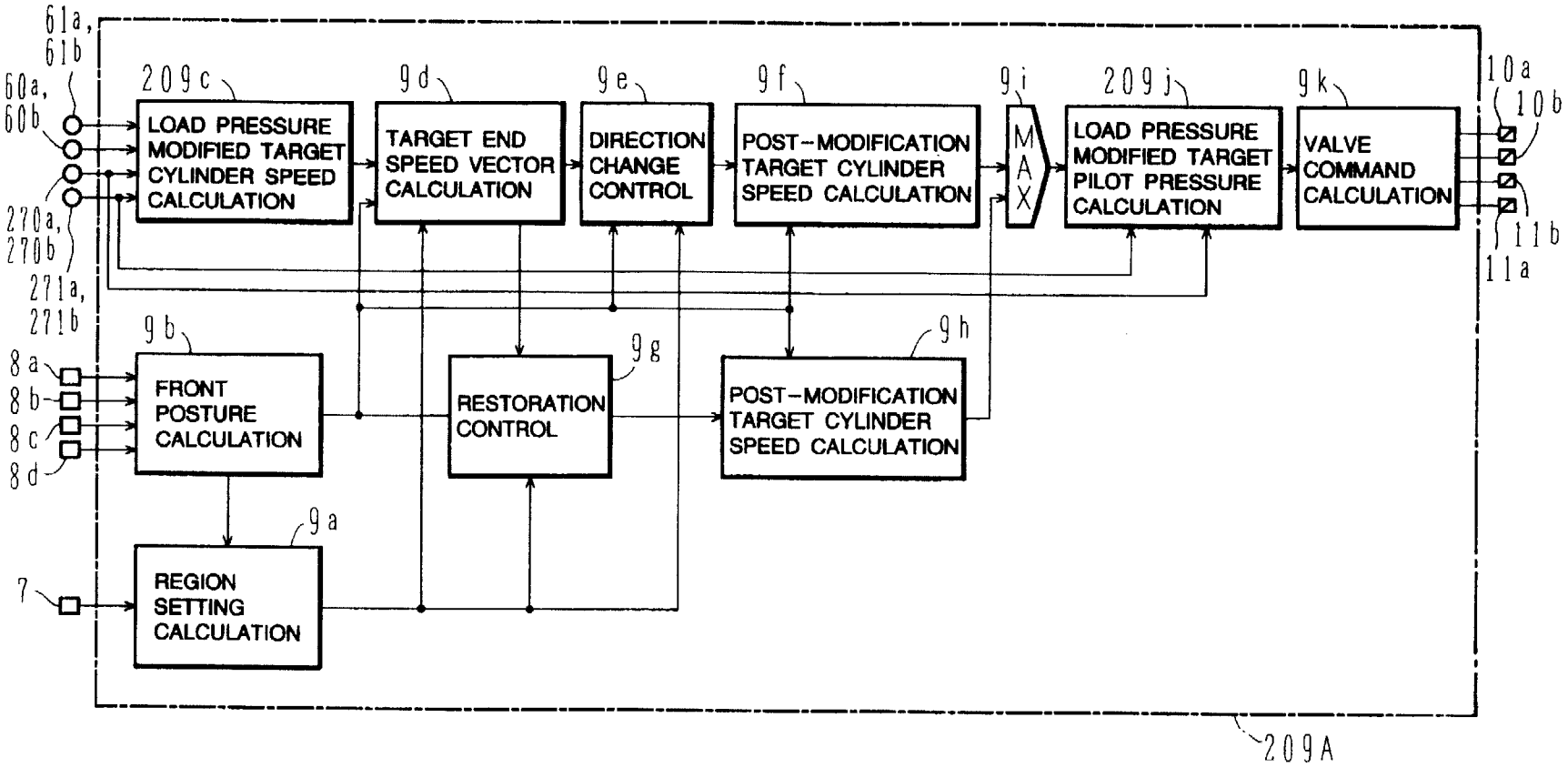
FIG. 21 is a functional block diagram showing control functions of a control unit.

A second embodiment of the present invention will be described with reference to FIGS. 19 to 21. In this embodiment, the present invention is applied to a hydraulic excavator having control lever units of hydraulic pilot pressure type. In FIGS. 19 and 21, identical members and functions to those shown in FIGS. 1 and 6 are denoted by the same reference numerals.

Referring to FIG. 19, control lever units 4a to 4f are each of the hydraulic pilot type driving corresponding ones of the flow control valves 5a to 5f with a pilot pressure. As shown in FIG. 20, each of the control lever units 4a to 4f comprises a control lever 40 manipulated by the operator, and a pair of pressure reducing valves 41, 42 for generating a pilot pressure depending on the amount and the direction by and in which the control lever 40 is manipulated. The pressure reducing valves 41, 42 are connected at the primary port side to a pilot pump 43, and at the secondary port side to corresponding ones of hydraulic driving sectors 50a, 50b; 51a, 51b; 52a, 52b; 53a, 53b; 54a, 54b; 55a, 55b of the flow control valves through pilot lines 44a, 44b; 45a, 45b; 46a, 46b; 47a, 47b; 48a, 48b; 49a, 49b.

A region limiting excavation control system of this embodiment comprises a setter 7, angle sensors 8a, 8b, 8c, an inclination angle sensor 8d, and pressure sensors 270a to 271b, all of which are the same as used in the first embodiment. The control system also comprises pressure sensors 60a, 60b; 61a, 61b disposed in the pilot lines 44a, 44b; 45a, 45b connected to the boom and arm control lever units 4a, 4b for detecting respective pilot pressures representative of input amounts from the control lever units 4a, 4b, a control unit 209A for receiving a set signal from the setter 7, detection signals from the angle sensors 8a, 8b, 8c and the inclination angle sensor 8d, detection signals from the pressure sensors 60a, 60b; 61a, 61b and detection signals from the pressure sensors 270a to 271b, setting the excavation region where the end of the bucket 1c is movable, and outputting electric signals to perform excavation control within the limited region, proportional solenoid valves 10a, 10b, 11a, 11b driven by the electric signals output from the control unit 209A, and a shuttle valve 12. The proportional solenoid valve 10a is connected at the primary port side to the pilot pump 43, and at the secondary port side to the shuttle valve 12. The shuttle valve 12 is disposed in the pilot line 44a and selects the higher one of the pilot pressure in the pilot line 44a and the control pressure delivered from the proportional solenoid valve 10a and introduces the selected pressure to the hydraulic driving sector 50a of the flow control valve 5a. The proportional solenoid valves 10b, 11a, 11b are disposed in the pilot lines 44b, 45a, 45b, respectively, and reduce the pilot pressures in the pilot lines in accordance with the respective electric signals applied thereto and output the reduced pilot pressures.

Control functions of the control unit 209A are shown in FIG. 21. A load pressure modified target cylinder speed calculator 209c receives the detection signals from the pressure sensors 60a, 60b; 61a, 61b as control signals from the control lever units. Based on the control signals (pilot pressures) and the load pressures detected by the pressure sensors 270a to 271b, the target cylinder speed calculator 209c calculates target delivered flow rates through the flow control valves 5a, 5b (and then target speeds of the boom cylinder 3a and the arm cylinder 3b) which have been modified depending on the load pressures, as with the first embodiment. Further, a memory of the control unit 209A stores the relationships FBU, FBD, FAC, FAD among the control signals (pilot pressures) PBU, PBD, PAC, PAD, the load pressures PLB1, PLB2, PLA1, PLA2, and the target delivered flow rates VB, VA through the flow control valves 5a, 5b as shown in FIG. 10. The target cylinder speed calculator 209c determines the target delivered flow rates through the flow control valves 5a, 5b by utilizing the above stored relationships.

A load pressure modified target pilot pressure calculator 209j calculates the target pilot pressures in the pilot lines 44a, 44b; 45a, 45b as respective target pilot pressures. Specifically, as with the first embodiment, the calculator 209j receives both the respective target cylinder speeds to be output which are selected by a target cylinder speed selector 9i and the load pressures detected by the pressure sensors 270a to 271b, and then calculates target pilot pressures (target operation command values) modified depending on the load pressures. Also, the memory of the control unit 209A stores the relationships GBU, GBD, GAC, GAD among the output target cylinder speeds VB', VA', the load pressures PLB1, PLB2, PLA1, PLA2, and the target pilot pressures P'BU, P'BD, P'AC, P'AD as shown in FIG. 18. The calculator 209j determines the target pilot pressures by utilizing the above stored relationships.

A valve command calculator 9k calculates command values corresponding to the target pilot pressures calculated by the target pilot pressure calculator 209j, and outputs corresponding electric signals to the proportional solenoid valves 10a, 10b, 11a, 11b.

Other control functions of the control unit 209A are the same as in the first embodiment shown in FIG. 6.

In the above arrangement, the pressure sensors 60a to 61b, the target cylinder speed calculator 209c, the target end speed vector calculator 9d, the direction change controller 9e, the restoration controller 9g, the post-modification target cylinder speed calculators 9f, 9h, the target cylinder speed selector 9i, the load pressure modified target pilot pressure calculator 209j, the valve command calculator 9k, the proportional solenoid valves 10a to 11b and the shuttle valve 12 make up signal modifying means for, based on the control signals from those ones 4a, 4b of the plurality of manipulation means which are associated with the front attachment 1A and the values calculated by the first calculating means (the front posture calculator 9b), carrying out calculation of the target speed vector Vca of the front attachment 1A, modifying the control signals from the manipulation means 4a, 4b associated with the front attachment 1A so that, when the front attachment 1A is within the set region near the boundary of the set region, the front attachment 1A is allowed to move in the direction along the boundary of the set region and a moving speed of the front attachment 1A in the direction toward the boundary of the set region is reduced, and modifying the control signals from the manipulation means 4a, 4b associated with the front attachment 1A so that, when the front attachment 1A is outside the set region, the front attachment 1A is returned to the set region. The load pressure modified target pilot pressure calculator 209j constitutes output modifying means for, based on the signals from the second detecting means (the pressure sensors 270a to 271b), further modifying, of the control signals modified by the above signal modifying means, the control signals from the manipulation means 4a, 4b which are associated with the particular front members (the boom 1a and the arm 1b) so that the front attachment 1A is moved as per the target speed vector Vca regardless of change in the load pressures of the particular front actuators (the boom cylinder 3a and the arm cylinder 3b).

The pressure sensors 60a to 61b, the target cylinder speed calculator 209c and the target end speed vector calculator 9d make up second calculating means for calculating the input target speed vector Vc of the front attachment 1A based on the control signals from the manipulation means 4a, 4b associated with the front attachment 1A. The direction change controller 9e and the restoration controller 9g make up third calculating means for modifying the input target speed vector Vc (in the direction change controller 9e) so that, when the front attachment 1A is within the set region near the boundary of the set region, the vector component of the input target speed vector Vc in the direction toward the boundary of the set region is reduced, and modifying the input target speed vector Vc (in the restoration controller 9g) so that, when the front attachment 1A is outside the set region, the front attachment is returned to the set region. The post-modification target cylinder speed calculator 9f, the target cylinder speed selector 9i, the target pilot pressure calculator 209j, the valve command calculator 9k, the proportional solenoid valves 10a to 11b and the shuttle valve 12 make up valve control means for driving the associated hydraulic control valves 5a, 5b so that the front attachment 1A is moved in accordance with the target speed vector Vca modified by the third calculating means. The output modifying means (the target pilot pressure calculator 209j) is constituted as part of the valve control means.

Also, the load pressure modified target cylinder speed calculator 209c constitutes input modifying means as with the first embodiment.

Further, the control lever units 4a to 4f and the pilot lines 44a to 49b make up a manipulation system for driving the hydraulic control valves 5a to 5f. Of the components making up the valve control means, the post-modification target cylinder speed calculator 9f, the target cylinder speed selector 9i, the target pilot pressure calculator 209j and the valve command calculator 9k make up electric signal generating means for calculating the target operation command values for the associated hydraulic control valves 5a, 5b based on the target speed vector Vca modified by the above third calculating means. The proportional solenoid valves 10a to 11b and the shuttle valve 12 make up pilot pressure modifying means for outputting, in accordance with the above electric signals, pilot pressures which are to be substituted for the pilot pressures from the manipulation means 4a, 4b. Here, the target pilot pressure calculator 209j modifies, in the calculation of the target operation command values, the command values associated with the particular actuators 3b depending on the load pressures detected by the second detecting means (the pressure sensors 270a to 271b). Also, the aforesaid output modifying means is constituted as part of the electric signal generating means.

The pilot line 44a constitutes a first pilot line for introducing a pilot pressure to the corresponding hydraulic control valve 5a so that the front attachment 1A is moved away from the set region. The proportional solenoid valve 10a constitutes electro-hydraulic converting means for converting the electric signal into a hydraulic signal. The shuttle valve 12 constitutes higher pressure selecting means for selecting higher one of the pilot pressure in the first pilot line and the hydraulic pressure output from the electro-hydraulic converting means, and introducing the selected pressure to the corresponding hydraulic control valve 5a.

The pilot lines 44b, 45a, 45b constitute second pilot lines for introducing pilot pressures to the corresponding hydraulic control valves 5a, 5b so that the front attachment 1A is moved toward the set region. The proportional solenoid valves 10b, 11a, 11b constitute pressure reducing means disposed in the second pilot lines for reducing the pilot pressures in the second pilot lines in accordance with the electric signals.

Let it be supposed that, in this embodiment having the above-explained arrangement, the direction change control is performed by the controller 9e during the arm-crowd operation. In this case, if the software is designed in the post-modification target cylinder speed calculator 9f to perform the direction change control in a combination of boom-up motion and deceleration of arm-crowd motion, the calculator 9f calculates a cylinder speed in the direction of extending the boom cylinder 3a and a cylinder speed in the direction of extending the arm cylinder 3b, the target pilot pressure calculator 209j calculates a target pilot pressure in the boom-up side pilot line 44a and a target pilot pressure in the arm-crowd side pilot line 45a, and the valve command calculator 9k outputs electric signals to the proportional solenoid valves 10a, 11a. Therefore, the proportional solenoid valve 10a outputs a control pressure corresponding to the target pilot pressure calculated by the calculator 209j, and the control pressure is selected by the shuttle valve 12 and introduced to the boom-up side hydraulic driving sector 50a of the boom flow control valve 5a. On the other hand, the proportional solenoid valve 11a reduces the pilot pressure in the pilot line 45a to the target pilot pressure calculated by the calculator 209j in accordance with the electric signal, and outputs the reduced pilot pressure to the arm-crowd side hydraulic driving sector 51a of the arm flow control valve 5b. With such operations of the proportional solenoid valves 10a, 11a, only the movement of the bucket end in the direction vertical to the boundary of the set region is controlled so as to slow down, enabling the end of the bucket 1c to be moved along the boundary of the set region.

Supposing now that the end of the bucket 1c goes out of the set region and the restoration control is made by the controller 9g, if the software is designed in the post-modification target cylinder speed calculator 9h to perform the restoration control in a combination of boom-up motion and deceleration of arm-crowd motion, the calculator 9h calculates a cylinder speed in the direction of extending the boom cylinder 3a and a cylinder speed in the direction of extending the arm cylinder 3b, the target pilot pressure calculator 209j calculates a target pilot pressure in the boom-up side pilot line 44a and a target pilot pressure in the arm-crowd side pilot line 45a, and the valve command calculator 9k outputs electric signals to the proportional solenoid valves 10a, 11a. As a result, the proportional solenoid valves 10a, 11a are operated as explained above so that the bucket end is controlled to quickly return to the set region, allowing excavation to be carried out on the boundary of the set region.

When digging work is performed while moving the bucket end along a predetermined path, e.g., the boundary of the set region, it is usually required for the operator to control the movement of the bucket end in the hydraulic pilot type system by manipulating at least two control levers of the boom control lever unit 4a and the arm control lever unit 4b. In this embodiment, the operator may of course manipulate both the control levers of the boom and arm control lever units 4a, 4b simultaneously, but if the operator only manipulates one arm control lever, the cylinder speeds of the hydraulic cylinders necessary for the direction change control or the restoration control are calculated by the calculator 9f or 9h as explained above, causing the bucket end to move along the boundary of the set region. Accordingly, the digging work along the boundary of the set region can be implemented by manipulating just one arm control lever.

During the digging work along the boundary of the set region, it is often required to manually raise the boom 1a in such a case as that a lot of earth has entered the bucket 1c, or there is an obstacle in the movement path of the bucket end, or digging resistance is to be reduced because the front attachment has stalled due to large digging resistance. In that case, the boom can be raised by manipulating the boom control lever unit 4a in the boom-up direction. Specifically, by so operating, a pilot pressure is established in the boom-up side pilot line 44a and, if the pilot pressure exceeds the control pressure produced from the proportional solenoid valve 10a, the pilot pressure is selected by the shuttle valve 12 to move up the boom.

Let it be supposed that the direction change control is performed by the controller 9e during the combined operation of boom-down and arm-dump. In this case, if the software is designed in the post-modification target cylinder speed calculator 9f to perform the direction change control in a combination of boom-up motion and deceleration of arm-dump motion, the calculator 9f calculates a cylinder speed in the direction of extending the boom cylinder 3a and a cylinder speed in the direction of contracting the arm cylinder 3b, the target pilot pressure calculator 209j calculates a target pilot pressure in the boom-up side pilot line 44a and a target pilot pressure in the arm-dump side pilot line 45b while setting the target pilot pressure in the boom-down side pilot line 44b to 0, and the valve command calculator 9k turns off the output of the proportional solenoid valve 10b and outputs electric signals to the proportional solenoid valves 10a, 11b. Therefore, the proportional solenoid valve 10b reduces the pilot pressure in the pilot line 44b to 0, the proportional solenoid valve 10a outputs a control pressure corresponding to the target pilot pressure as the pilot pressure in the pilot line 44a, and the proportional solenoid valve 11b reduces the pilot pressure in the pilot line 45b to the target pilot pressure. With such operations of the proportional solenoid valves 10a, 10b, 11b, the direction change control is performed as with the above case of the arm-crowd operation. It is thus possible to quickly move the end of the bucket 1c along the boundary of the set region.

Supposing now that the end of the bucket 1c goes out of the set region and the restoration control is made by the controller 9g, if the software is designed in the post-modification target cylinder speed calculator 9h to perform the restoration control in a combination of boom-up motion and deceleration of arm-dump motion, as with the above case of the direction change control, the calculator 9h calculates a cylinder speed in the direction of extending the boom cylinder 3a and a cylinder speed in the direction of contracting the arm cylinder 3b, the target pilot pressure calculator 209j calculates a target pilot pressure in the boom-up side pilot line 44a and a target pilot pressure in the arm-dump side pilot line 45b, and the valve command calculator 9k outputs electric signals to the proportional solenoid valves 10a, 11a. As a result, the bucket end is controlled to quickly return to the set region, allowing excavation to be carried out on the boundary of the set region.

Further, if the control lever is manipulated to raise the boom during the control process, the boom can be moved up as with the above case of the arm-crowd operation.

When the movement of the front attachment 1A is controlled as stated above, the target pilot pressure calculator 209j calculates the target pilot pressures P'BU, P'BD, P'AC, P'AD modified depending on the load pressures, and the target cylinder speed calculator 209c also calculates the target delivered flow rates through the flow control valves 5a, 5b modified depending on the load pressures. As a result, stable control is achieved with good accuracy regardless of change in the load pressures.

With this embodiment, consequently, similar advantages to those in the first embodiment can also be provided in the system employing the control lever units 4a, 4b of hydraulic pilot type.

Since the pilot pressures are modified by incorporating the proportional solenoid valves 10a, 10b, 11a, 11b and the shuttle valve 12 in the pilot lines 44a, 44b, 45a, 45b, the function of the present invention can easily be added to any system having the control lever units 4a, 4b of hydraulic pilot type.

Additionally, in a hydraulic excavator having the control lever units 4a, 4b of hydraulic pilot type, the digging work along the boundary of the set region can be implemented by manipulating Just one arm control lever.

Third Embodiment

Figure 22:
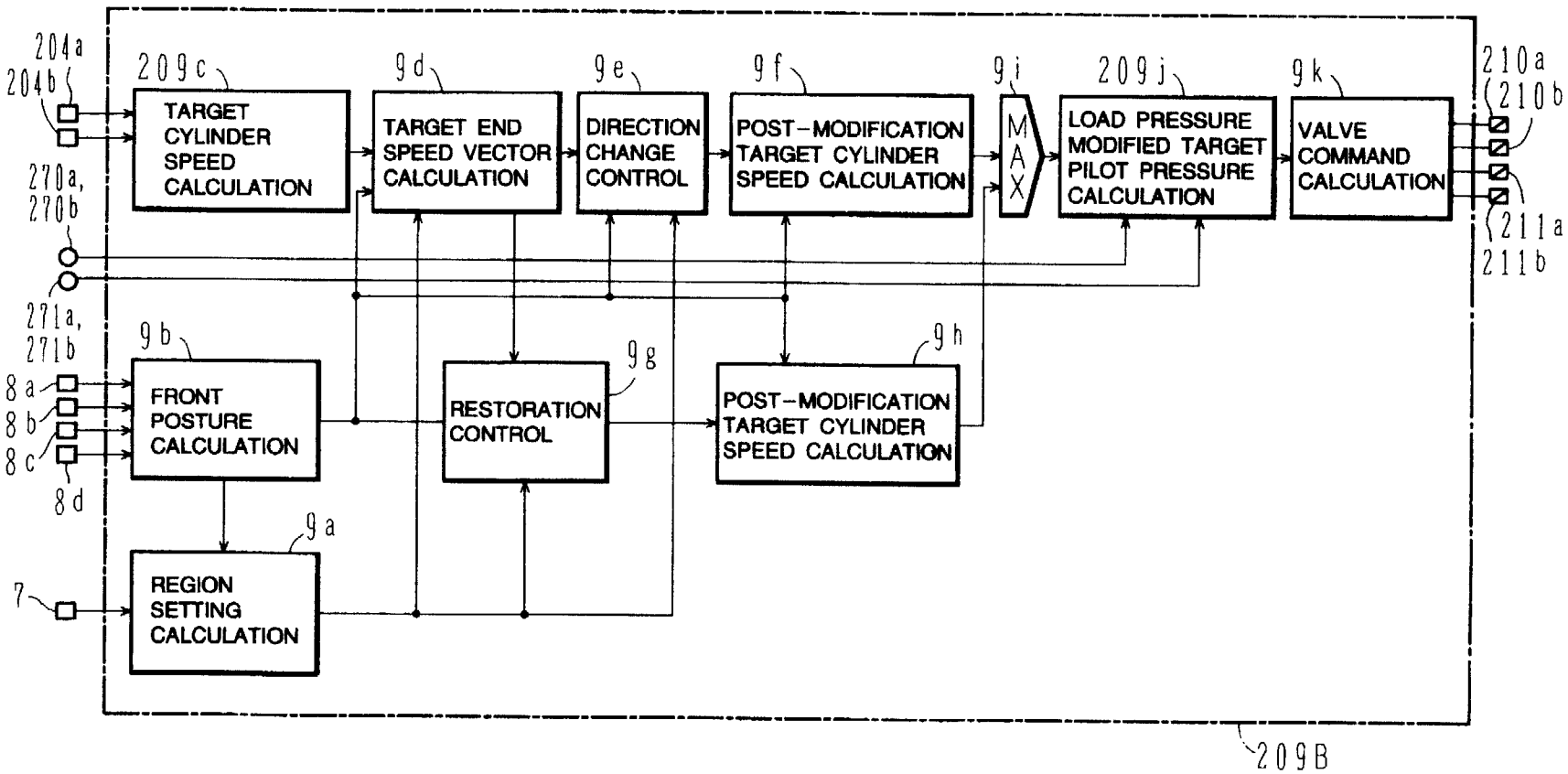
FIG. 22 is a functional block diagram showing control functions of a control unit for use in a region limiting excavation control system for a construction machine according to a third embodiment of the present invention.
Figure 23:
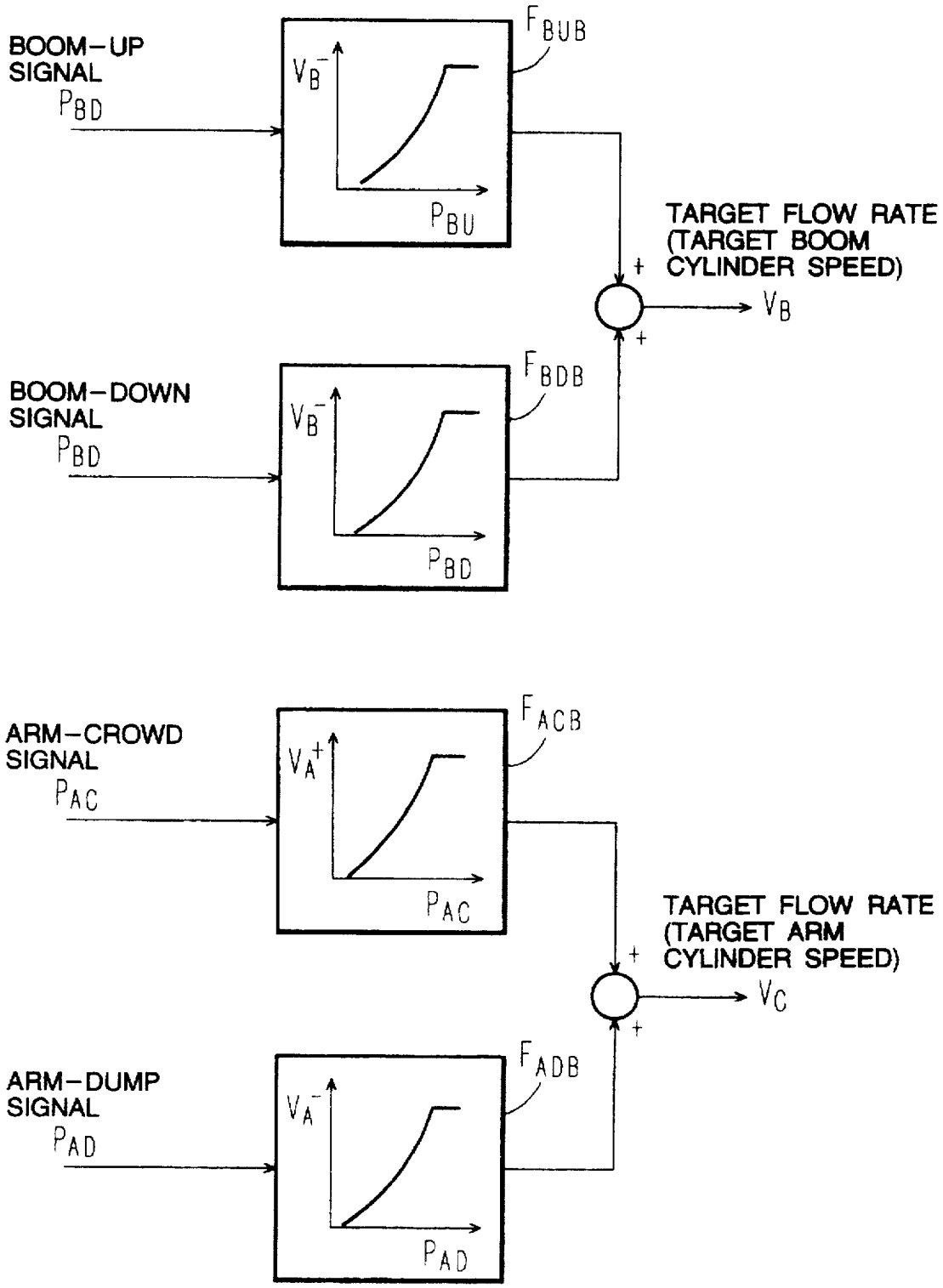
FIG. 23 is a diagram showing the relationship between control signals and flow rates delivered through the flow control valves in a target cylinder speed calculator.

A third embodiment of the present invention will be described with reference to FIGS. 22 and 23. This embodiment intends to perform modification depending on the load pressures in the target pilot pressure calculator alone. In FIG. 22, identical functions to those shown in FIG. 6 are denoted by the same reference numerals.

Referring to FIG. 22, a target cylinder speed calculator 209c receives only the electric signals from the control lever units 204a, 204b, determines target delivered flow rates through the flow control valves 5a, 5b, and then calculates target speeds of the boom cylinder 3a and the arm cylinder 3b from the target delivered flow rates. A memory of a control unit 209 stores relationships FBUB, FBDB, FACB, FADB between the control signals PBU, PBD, PAC, PAD and the target delivered flow rates VB, VA through the flow control valves 5a, 5b as shown in FIG. 23. The target cylinder speed calculator 209c determines the target delivered flow rates through the flow control valves 5a, 5b by utilizing the above stored relationships. Incidentally, the relationships FBUB, FBDB, FACB, FADB shown in FIG. 23 are prepared based on average flow rate load characteristics of the flow control valves 5a, 5b.

On the other hand, a load pressure modified target pilot pressure calculator 209j has the same function as in the first embodiment. Specifically, the calculator 209j receives both the respective target cylinder speeds to be output which are selected by a target cylinder speed selector 9i and the load pressures detected by the pressure sensors 270a to 271b, and then calculates target pilot pressures (target operation command values) modified depending on the load pressures.

In this embodiment, the target cylinder speeds are not modified depending on the load pressures in the target cylinder speed calculator 209c. Therefore, the target speed vector Vc calculated by a target end speed vector calculator 9d is somewhat deviated from the actual movement. But the calculated target speed vector is used in a direction change controller 9e and a restoration controller 9g for each control process anyhow. Specifically, the direction change controller 9e modifies the target speed vector Vc so as to effect the direction change control if the distance between the bucket end and the boundary of the set region becomes smaller than Ya, and the restoration controller 9g modifies the target speed vector Vc so as to effect the restoration control 9g if the bucket end goes out of the set region beyond the boundary.

On the other hand, since the target pilot pressures are modified depending on the load pressures in the load pressure modified target pilot pressure calculator 209j as with the first embodiment, the deviation between the calculated value of the target speed vector on the control basis and the actual movement is reduced and the actual end position of the bucket 1c is prevented from deviating from the calculated position on the control basis to a large extent. Therefore, when digging work is implemented along the boundary of the set region, the work can be controlled with good accuracy in point of, e.g., enabling the end of the bucket 1c to be precisely moved along the boundary of the set region. Also, stable control is achieved because of yielding no large deviations in the control process.

Accordingly, this embodiment can simplify the software and reduce the manufacture cost, while providing almost similar advantages to those in the first embodiment.

Fourth Embodiment

A fourth embodiment of the present invention will be described with reference to FIGS. 24 to 27. In this embodiment, control is modified by detecting only the load pressure in the boom-up operation that maximally affects the control. In FIGS. 24 to 27, identical members and functions to those shown in FIGS. 1, 6, 10 and 18 are denoted by the same reference numerals.

Figure 24:
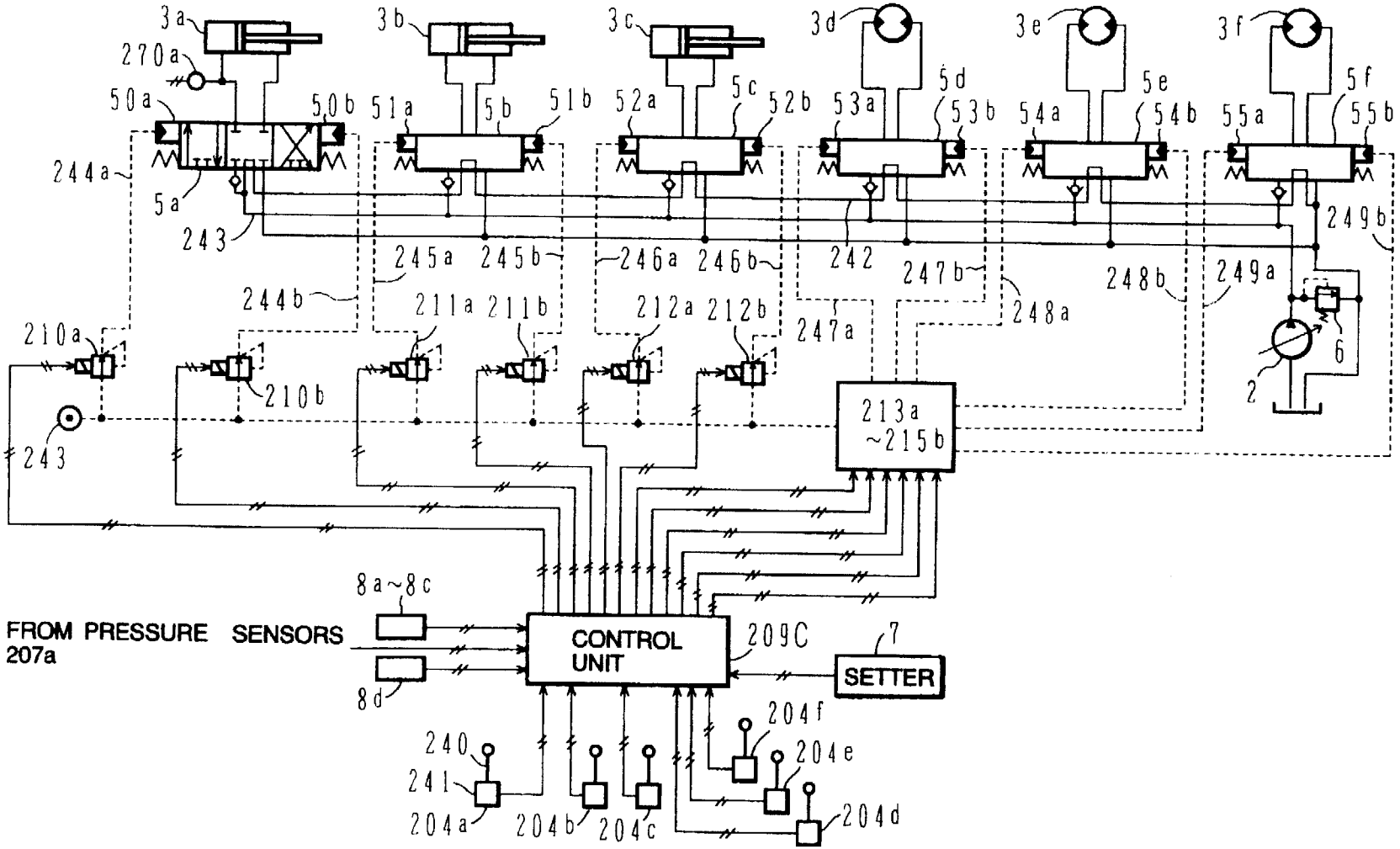
FIG. 24 is a diagram showing a region limiting excavation control system for a construction machine according to a fourth embodiment of the present invention, along with a hydraulic drive system for the control system.

Referring to FIG. 24, a region limiting excavation control system of this embodiment includes, as load pressure detecting means, only a pressure sensor 270a for detecting a load pressure produced when the boom cylinder 3a is operated in the boom-up direction. A detection signal from the pressure sensor 270a is input to a control unit 209C.

Figure 25:
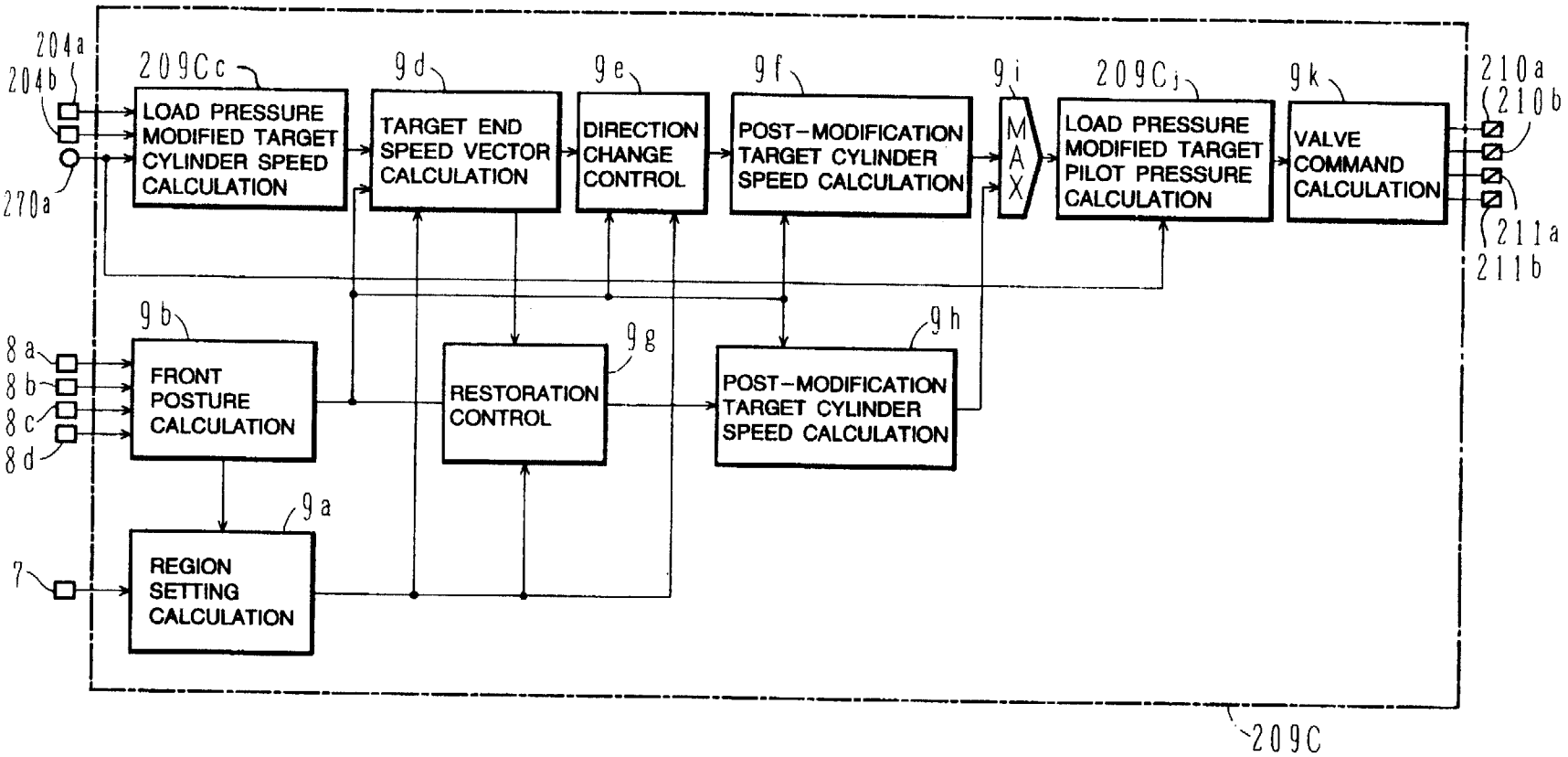
FIG. 25 is a functional block diagram showing control functions of a control unit.
Figure 26:
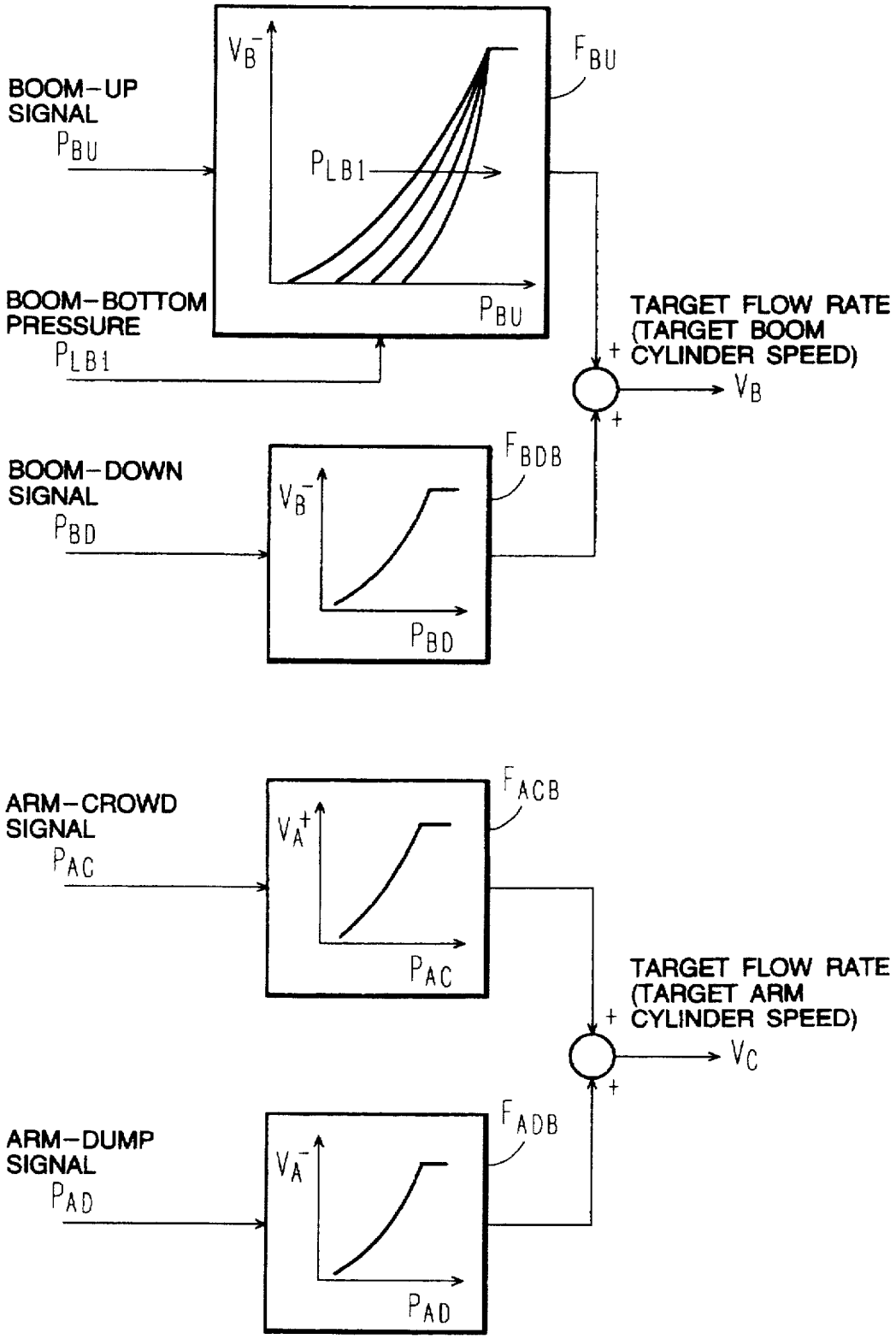
FIG. 26 is a diagram showing the relationship among a control signal, a load pressure and a flow rate delivered through the flow control valve, as well as the relationship between control signals and delivered flow rates in a target cylinder speed calculator.

Control functions of the control unit 209C are shown in FIG. 25. A load pressure modified target cylinder speed calculator 209Cc receives the electric signals (control signals) from the control lever units 204a, 204b and the load pressure detected by the pressure sensor 270a, determines target delivered flow rates through the flow control valves 5a, 5b the former of which has been modified depending on the load pressure, and then calculates target speeds of the boom cylinder 3a and the arm cylinder 3b from the target delivered flow rates. A memory of the control unit 209C stores a relationship FBU among the control signal PBU, the load pressure PLB1 and the target delivered flow rates VB through the flow control valve 5a, as well as relationships FBDB, FACB, FADB between the control signals PBD, PAC, PAD and the target delivered flow rates VB, VA through the flow control valves 5a, 5b, as shown in FIG. 26. The target cylinder speed calculator 209Cc determines the target delivered flow rates through the flow control valves 5a, 5b by utilizing the above stored relationships.

Here, the relationship FBU shown in FIG. 26 is the same as the relationship FBU shown in FIG. 10 and is prepared based on the flow rate load characteristics of the flow control valves 5a, 5b shown in FIG. 5. The relationships FBDB, FACB, FADB shown in FIG. 26 are the same as the relationships FBDB, FACB, FADB shown in FIG. 23 and are prepared based on average flow rate load characteristics of the flow control valves 5a, 5b.

Figure 27:
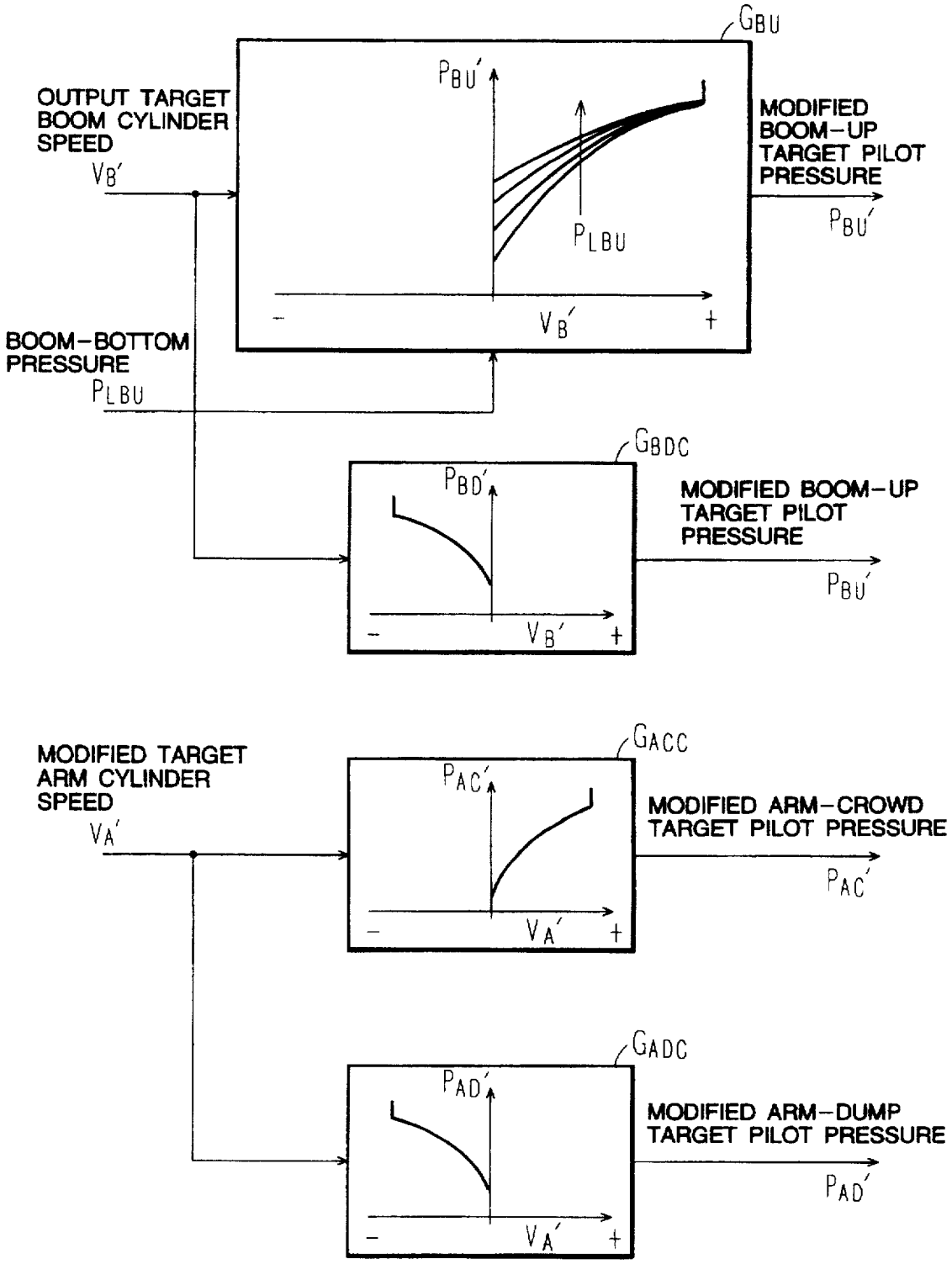
FIG. 27 is a diagram showing the relationship among an output cylinder speed, a load pressure and a target pilot pressure, as well as the relationships between output cylinder speeds and target pilot pressures in a target pilot pressure calculator.

A load pressure modified target pilot pressure calculator 209Cj receives both the target cylinder speed to be output which is selected by a target cylinder speed selector 9i and the load pressure detected by the pressure sensor 270a, and then calculates a target pilot pressure (target operation command value) modified depending on the load pressure. Also, the memory of the control unit 209C stores a relationship GBU among the output target cylinder speed VB', the load pressure PLB1 and the target pilot pressure P'BU, as well as relationships GBDC, GACC, GADC between the output target cylinder speeds VB', VA' and the target pilot pressures P'BD, P'AC, P'AD, as shown in FIG. 27. The target pilot pressure calculator 209C*j* determines the target pilot pressures for driving the flow control valves 5*a*, 5*b* by utilizing the above stored relationships.

Here, the relationship GBU shown in FIG. 27 is the same as the relationship GBU shown in FIG. 18 and is prepared based on the flow rate load characteristics of the flow control valves 5*a*, 5*b* shown in FIG. 5. The relationships GBDC, GACC, GADC shown in FIG. 27 are prepared based on average flow rate load characteristics of the flow control valves 5*a*, 5*b*.

In this embodiment, the target cylinder speed and the target pilot pressure are modified depending on only the load pressure produced in the boom-up operation in the target cylinder speed calculator 209C*c* and the target pilot pressure calculator 209C*j*. Therefore, the deviation between the calculated value of the target speed vector on the control basis and the actual movement is a little larger than in the first embodiment and, correspondingly, an improvement in control accuracy and stability is somewhat reduced. As is apparent from the above description, however, the condition where a hydraulic actuator must be moved against the load in the direction change control and the restoration control in the present invention is primarily occurred in the case of raising the boom. That is to say, change in the flow rate characteristic of the flow control valve 5*a* depending on change in the load pressure in the boom-up direction maximally affects the deviation between the calculated value of the target speed vector on the control basis and the actual movement. From this reason, this embodiment intends to detect only the load pressure produced in the boom-up operation for modification of the control.

This embodiment can simplify the software and reduce the manufacture cost, while providing almost similar advantages to those in the first embodiment. In addition, the production cost can be reduced from the hardware point of view as well because this embodiment requires only one pressure sensor.

While the third and fourth embodiments are applied to the hydraulic system having the control lever units of electric lever type, they may similarly be applied to a hydraulic system having the control lever units of hydraulic pilot type like the second embodiment.

Other Embodiments

Still other embodiments of the present invention will be described with reference to FIGS. 28 and 29. The foregoing embodiments have been described of a hydraulic excavator having a front attachment or device of three-fold structure comprising a boom, an arm and a bucket. However, there are other various types of hydraulic excavators having front attachments or device of different structures, and the present invention is also applicable to those other types of hydraulic excavators.

Figure 28:
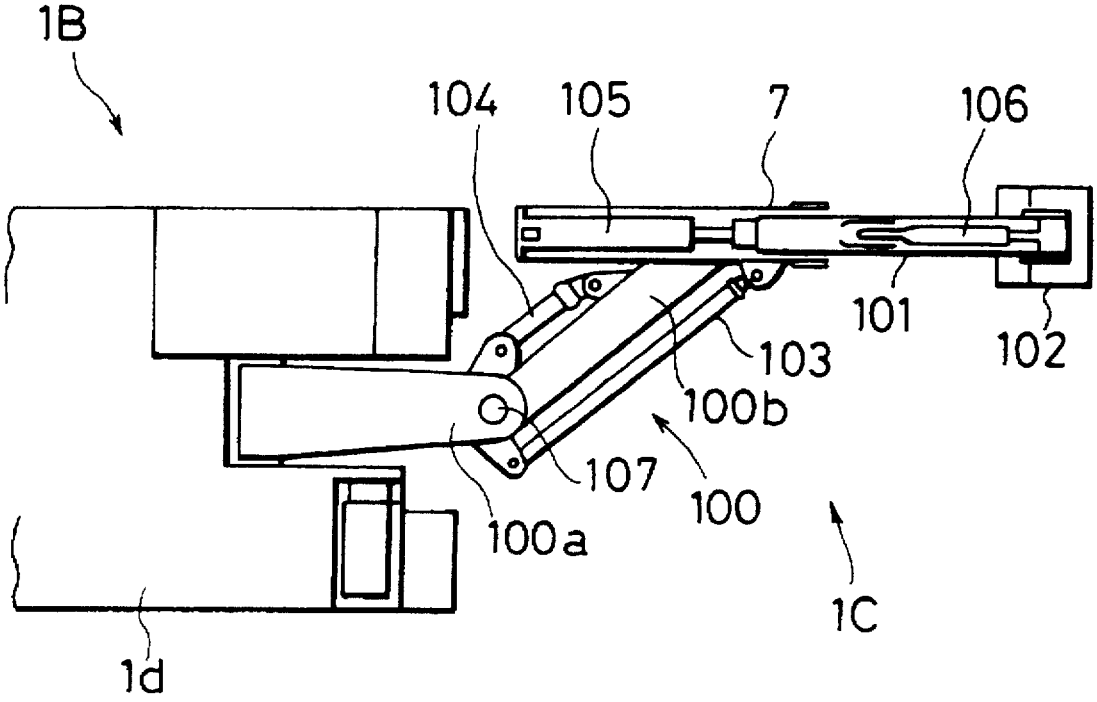
FIG. 28 is a top plan view of an offset type hydraulic excavator to which the present invention is applied, as still another embodiment of the present invention.

FIG. 28 shows an offset type hydraulic excavator in which a boom can be swung transversely. This hydraulic excavator includes a multi-articulated front attachment 1C comprising an offset boom 100 consisted of a first boom 100*a* rotatable in the vertical direction and a second boom 100*b* swingable in the horizontal direction with respect to the first boom 100*a*, an arm 101 rotatable in the vertical direction with respect to the second boom 100*b*, and a bucket 102. A link 103 is disposed parallel on one side of the second boom 100*b*, and has one end coupled to the first boom 1*a* by a pin and the other end coupled to the arm 101 by a pin. The first boom 100*a* is driven by a first boom cylinder (not shown) which is similar to the boom cylinder 3*a* of the hydraulic excavator shown in FIG. 2. The second boom 100*b*, the arm 101 and the bucket 102 are driven respectively by a second boom cylinder 104, an arm cylinder 105 and a bucket cylinder 106. In such a hydraulic excavator, an angle sensor 107 for detecting a swing angle (offset amount) of the second boom 100*b* is provided as means for detecting status variables with regard to the position and posture of the front attachment 1*c*, in addition to the angle sensors 8*a*, 8*b*, 8*c* in the first embodiment and the inclination angle sensor 8*d*. A detection signal from the angle sensor 107 is also input to, for example, the front posture calculator 9*b* in the control unit 209 shown in FIG. 6 for modifying the boom length (i.e., the distance from a base end of the first boom 100*a* to a distal end of the second boom 100*b*). Thus, the present invention can be applied to the offset type hydraulic excavator as with the first to fourth embodiments.

Figure 29:
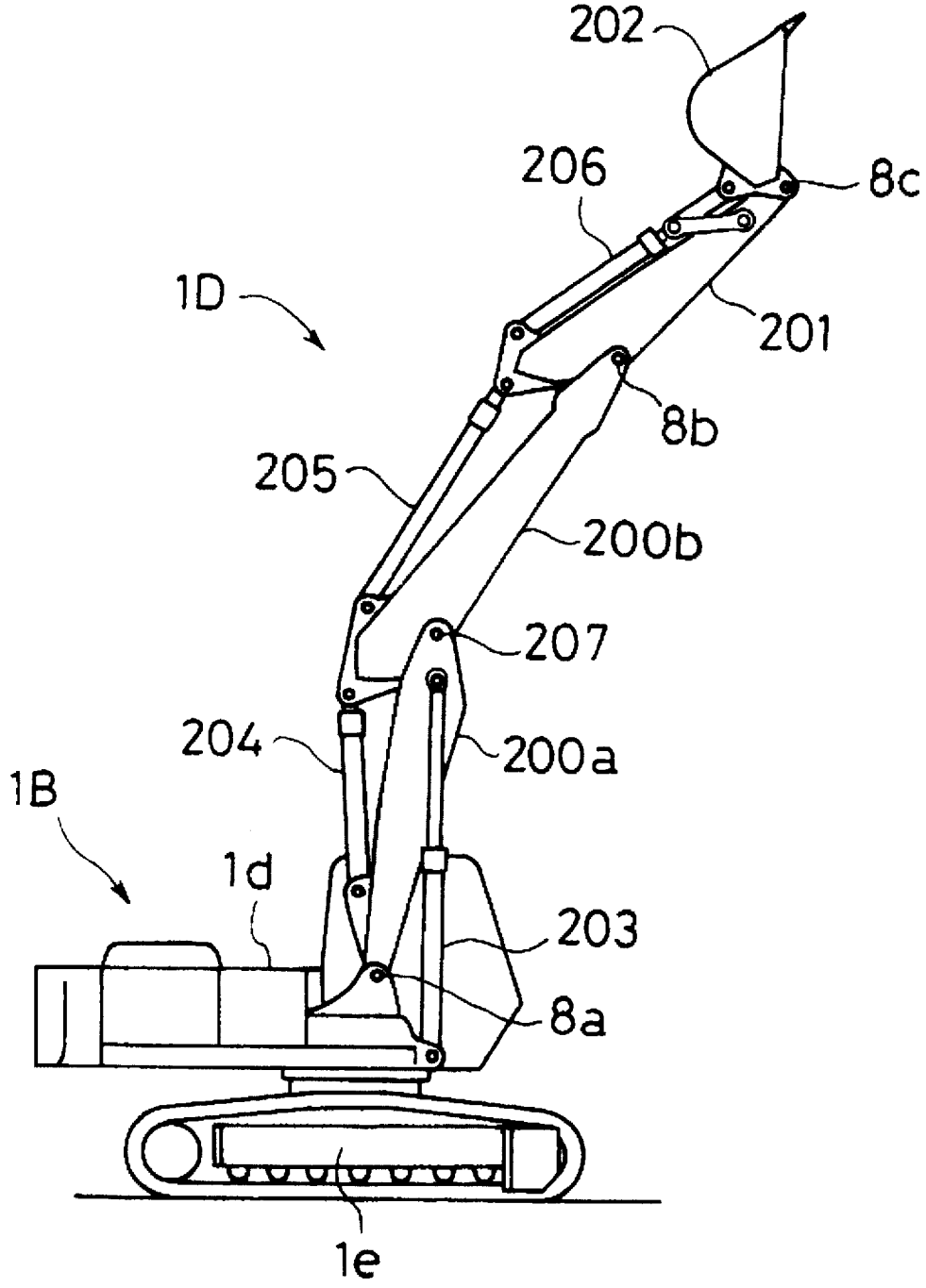
FIG. 29 is a side view of a two-piece beam type hydraulic excavator to which the present invention is applied, as still another embodiment of the present invention.

FIG. 29 shows a two-piece boom type hydraulic excavator in which a boom is divided into two parts. This hydraulic excavator includes a multi-articulated front attachment 1D comprising a first boom 200*a*, a second boom 200*b*, an arm 201 and a bucket 202. The first boom 100*a*, the second boom 200*b*, the arm 201 and the bucket 202 are driven respectively by a first boom cylinder 203, a second boom cylinder 204, an arm cylinder 205 and a bucket cylinder 206. In such a hydraulic excavator, an angle sensor 207 for detecting a rotational angle of the second boom 200*b* is provided as means for detecting status variables with regard to the position and posture of the front attachment 1*c*, in addition to the angle sensors 8*a*, 8*b*, 8*c* in the first embodiment and the inclination angle sensor 8*d*. A detection signal from the angle sensor 207 is also input to, for example, the front posture calculator 9*b* in the control unit 209 shown in FIG. 6 for modifying the boom length (i.e., the distance from a base end of the first boom 200*a* to a distal end of the second boom 200*b*). Thus, the present invention can be applied to the two-piece beam type hydraulic excavator as with the first to fourth embodiments.

In the foregoing embodiments, the predetermined location of the front attachment has been described as the end of the bucket. However, from the viewpoint of implementing the present invention in a simpler way, a pin at the arm tip end may be set to the predetermined location. Further, when the excavation region is set for the purpose of preventing interference between the front attachment and any other part, the predetermined location may be set as other suitable location where the interference would occur.

The proportional solenoid valves are employed as the electro-hydraulic converting means and the pressure reducing means, but they may be of any other suitable electro-hydraulic converting means.

While the hydraulic drive system to which the present invention is applied has been described as an open center system employing the flow control valves 5*a* to 5*f* of center bypass type, the present invention is also applicable to a closed center system employing flow control valves of closed center type.

The foregoing embodiments are arranged such that when the bucket end is away from the boundary of the set region, the target speed vector is output as it is. But in such a condition, the target speed vector may also be modified for any other purpose.

While the vector component of the target speed vector in the direction toward the boundary of the set region has been described as a vector component vertical to the boundary of the set region, it may be deviated from the vertical direction so long as the bucket end can be moved in the direction along the boundary of the set region.

According to the present invention, since the movement of the front attachment in the direction toward the boundary of the set region is slowed down when it comes closer to the set region, the excavation within a limited region can efficiently be implemented.

Even with the load pressure changed during the excavation within a limited region, the deviation between the calculated value of the target speed vector on the control basis and the actual movement is so reduced as to achieve control with good accuracy. Also, stable control is realized because of yielding no large deviations in the control process.

Further, according to the present invention, the function of efficiently implementing the excavation within a limited region can easily be added to any system including the manipulation means of hydraulic pilot type. When the hydraulic drive system includes boom manipulation means and arm manipulation means of a hydraulic excavator as the manipulation means associated with the front members, digging work along the boundary of the set region can be implemented by using just one arm control lever.

According to the present invention, since the front attachment is controlled so as to return when it enters the set region, the excavation within a limited region can precisely be implemented even if the front attachment is moved fast, resulting in improved efficiency. Further, since the deceleration control is performed beforehand, the excavation within a limited region can smoothly be implemented even if the front attachment is moved fast..

Additionally, according to the present invention, when the front attachment is away from the set region, the excavation can be implemented in a like manner to normal work.

We claim:

1. An excavation area limiting control system for limitingly controlling an area to be excavated in a construction machine, comprising a plurality of driven members (1*a*–1*f*) including a plurality of front members (1*a*–1*c*) which make up a multi-articulated type front device (1A) and are vertically rotatable, a plurality of hydraulic actuators (3*a*–3*f*) for respectively driving said plurality of driven members, a plurality of manipulation means (204*a*–204*f*; 4*a*–4*f*) for instructing operation of said plurality of driven members, and a plurality of hydraulic control valves (5*a*–5*f*) driven in accordance with control signals from said plurality of manipulation means for controlling flow rates of a hydraulic fluid supplied to said plurality of hydraulic actuators, wherein said system further comprises:

(a) area setting means (7, 9*a*) for setting an area to be excavated by said front device (1A);

(b) first detecting means (8*a*–8*d*) for detecting status variables with regard to the position and posture of said front device;

(c) second detecting means (270*a*–271*b*; 270*a*) for detecting load pressures of particular front actuators (3*a*, 3*b*; 3*a*) of said plurality of hydraulic actuators (3*a*–3*f*) which are associated with at least one or more particular front members (1*a*, 1*b*; 1*a*);

(d) first calculating means (9*b*) for calculating the position and posture of said front device based on signals from said first detecting means;

(e) signal modifying means (209*c*, 9*d*–9*i*, 209*j*, 9*k*, 210*a*–211*b*; 10*a*–11*b*; 12) for, based on the control signals from the manipulation means (204*a*, 204*b*; 4*a*, 4*b*) of said plurality of manipulation means which are associated with said front device and the values calculated by said first calculating means, carrying out calculation of a target speed vector (Vca) of said front device and modifying the control signals from the manipulation means (204*a*, 204*b*; 4*a*, 4*b*) associated with said front device so that, when said front device is within said set area to be excavated and near the boundary of said set area, said front device is allowed to move in the direction along the boundary of said set area to be excavated and a moving speed of said front device in the direction toward the boundary of said set area to be excavated is reduced, and further said front device is allowed to move in the direction along the boundary of said set area to be excavated even when the front device reaches said boundary of the set area; and (f) output modifying means (209*j*, 209C*j*) for, based on signals from said second detecting means (270*a*–271*b*; 270*a*), further modifying, of the control signals modified by said signal modifying means, the control signals from the manipulation means (204*a*, 204*b*; 4*a*, 4*b*; 204*a*; 4*a*) which are associated with said particular front members (1*a*, 1*b*; 1*a*) so that said front device is moved as per said target speed vector (Vca) regardless of change in the load pressures of said particular front actuators (3*a*, 3*b*; 3*a*).

2. An excavation area limiting control system for a construction machine according to claim 1, wherein said signal modifying means comprises second calculating means (209*c*, 9*d*) for calculating an input target speed vector (Vc) of said front device based on the control signals from the manipulation means (204*a*–204*c*; 4*a*–4*c*) associated with said front device (1A), third calculating means (9*e*) for modifying said input target speed vector (Vc) so that a vector component of said input target speed vector (Vc) in the direction toward the boundary of said set area is reduced, and valve control means (9*f*, 209*j*, 9*k*, 210*a*–211*b*; 10*a*–11*b*, 12) for driving the associated hydraulic control valves (5*a*, 5*b*) so that said front device is moved in accordance with the target speed vector (Vca) modified by said third calculating means, and wherein said output modifying means is constituted as part (209*j* ) of said valve control means.

3. An excavation area limiting control system for a construction machine according to claim 1, wherein said signal modifying means carries out, based on the control signals from those ones (204*a*–204*c*; 4*a*–4*c*) of said plurality of manipulation means which are associated with said front device (1A) and the values calculated by said first calculating means, calculation of a target speed vector (Vca) of said front device, modifies the control signals from the manipulation means associated with said front device so that, when said front device is within said set area near the boundary of said set area, said front device is allowed to move in the direction along the boundary of said set area and a moving speed of said front device in the direction toward the boundary of said set area is reduced, and modifies the control signals from the manipulation means (204*a*, 204*b*; 4*a*, 4*b*) associated with said front device so that, when said front device is outside said set area, said front device is returned to said set area, and wherein said output modifying means (209*j* ; 209C*j*) further modifies, based on signals from said second detecting means (270*a*–271*b*; 270*a*), the control signals from the manipulation means (204*a*, 204*b*; 4*a*, 4*b*; 204*a*; 4*a*) which are associated with said particular front members (1*a*, 1*b*; 1*a*) for any case of modification of the control signals so that said front device is moved as per said target speed vector (Vca) regardless of change in the load pressures of said particular front actuators (3*a*, 3*b*; 3*a*).

4. An excavation area limiting control system for a construction machine according to claim 3, wherein said signal modifying means includes second calculating means (209c, 9d) for calculating an input target speed vector (Vc) of said front device based on the control signals from the manipulation means (204a–204c; 4a–4c) associated with said front device (1A), third calculating means (9e, 9g) for modifying said input target speed vector (Vc) so that, when said front device is within said set area near the boundary of said set area, a vector component of said input target speed vector in the direction toward the boundary of said set area is reduced, and modifying said input target speed vector (Vc) so that, when said front device is outside said set area, said front device is returned to said set area, and valve control means (9f, 9h, 9i, 209j, 9k, 210a–211b; 10a–11b, 12) for driving the associated hydraulic control valves so that said front device is moved in accordance with the target speed vector (Vca) modified by said third calculating means, and wherein said output modifying means is constituted as part (209j ) of said valve control means.

5. An excavation area limiting control system for a construction machine according to claim 2, wherein said valve control means includes fourth calculating means (9f, 209j ; 9f, 9h, 9i, 209j ) for calculating target operation command values for said associated hydraulic control valves (5a, 5b) based on the target speed vector (Vca) modified by said third calculating means (9e; 9e. 9g), and output means (9k, 210–211b; 10a–10b, 12) for producing control signals for said associated hydraulic control valves (5a, 5b) based on the target operation command values calculated by said fourth calculating means, and wherein said output modifying means is constituted as part (209j ) of said fourth calculating means and, in the calculation of said target operation command values, modifies those ones of said target operation command values which are associated with said particular front actuators (3a, 3b; 3a), depending on the load pressures detected by said second detecting means (270a–271b; 270a).

6. An excavation area limiting control system for a construction machine according to claim 5, wherein said fourth calculating means includes target actuator speed calculating means (9f, 9h ) for calculating target actuator speeds from the target speed vector (Vca) modified by said third calculating means (9e; 9e, 9g), and target operation command value calculating means (209j ) for calculating the target operation command values for said associated hydraulic control valves (5a, 5b) from said target actuator speeds and the load pressures detected by said second detecting means (270a–271b; 270a) in accordance with preset characteristics.

7. An excavation area limiting control system for a construction machine according to claim 1, wherein said signal modifying means includes second calculating means (209c, 9d) for calculating an input target speed vector (Vc) of said front attachment based on the control signals from the manipulation means (204a, 204b; 4a, 4b) associated with said front attachment (1A), and third calculating means (9e) for modifying said input target speed vector (Vc) so that a vector component of said input target speed vector in the direction toward the boundary of said set area is reduced and said system further comprises input modifying means (209c) for, based on the signals from said second detecting means (270a–271b; 270a), modifying the input target speed vector (Vc) calculated by said second calculating means so that the speed vector corresponding to the control signals from said manipulation means is obtained regardless of change in the load pressures of said particular front actuators (3a, 3b; 3a).

8. An excavation area limiting control system for a construction machine according to claim 7, wherein said second calculating means includes fifth calculating means (209c) for calculating input target actuator speeds based on the control signals from the manipulation means (204a, 204b; 4a, 4b) associated with said front device (1A), and sixth calculating means for calculating the input target speed vector (Vc) of said front device from the input target actuator speeds calculated by said fifth calculating means, and wherein said input modifying means is constituted as part (209c) of said fifth calculating means and, in the calculation of said input target actuator speeds, modifies the input target actuator speeds of said particular front actuators (3a, 3b; 3a) depending on the load pressures detected by said second detecting means (270a–271b; 270a).

9. An excavation area limiting control system for a construction machine according to claim 8, wherein said fifth calculating means calculates said input target actuator speeds from the control signals from the manipulation means (204a, 204b; 4a, 4b) associated with said front device (1A) and the load pressures detected by the second detecting means (270a–271b; 270a) in accordance with the preset characteristics.

10. An excavation area limiting control system for a construction machine according to claim 6, wherein said preset characteristics are determined based on flow rate load characteristics of the hydraulic control valves (5a, 5b; 5a) associated with said particular front actuators (3a, 3b; 3a).

11. An excavation area limiting control system for a construction machine according to claim 2, said plurality of manipulation means being manipulation means (204a–204f) of an electric lever type generating electric signals as said control signals, wherein:

said valve control means includes electric signal generating means (9f, 209j, 9k; 9f, 9h, 9I, 209j, 9k) for calculating target operation command values for said associated hydraulic control valves (5a, 5b) based on the target speed vector (Vca) modified by said third calculating means (9e; 9e, 9g) and outputting electric signals corresponding to the calculated target operation command values, and electro-hydraulic converting means (210–211b) for converting said electric signals into hydraulic signals and outputting said hydraulic signals to said associated hydraulic control valves (5a, 5b), and wherein said output modifying means is constituted as part (209c) of said electric signal generating means and, in the calculation of said target operation command values, modifies those ones of said target operation command values which are associated with said particular front actuators (3a, 3b; 3a), depending on the load pressures detected by said second detecting means (270a–271b; 270a).

12. An excavation area limiting control system for a construction machine according to claim 2, said plurality of manipulation means (4a–4f) being of a hydraulic pilot type generating pilot pressures as said control signals, the associated hydraulic control valves (5a–5f) being driven by a manipulation system including said manipulation means of a hydraulic pilot type, wherein:

said valve control means includes electric signal generating means (9f, 209j, 9k; 9f, 9h, 9i, 209j, 9k) for calculating target operation command values for said associated hydraulic control valves (5a, 5b) based on the target speed vector (Vca) modified by said third calculating means (9e; 9e, 9g) and outputting electric signals corresponding to the calculated target operation command values, and pilot pressure modifying means (10a–11b, 12) for outputting, in accordance with said electric signals, pilot pressures which are to be substituted for the pilot pressures from said manipulation means, and wherein said output modifying means is constituted as part (209*j* ) of said electric signal generating means and, in the calculation of said target operation command values, modifies those ones of said target operation command values which are associated said particular front actuators (3*a*, 3*b*; 3*a*), depending on the load pressures detected by said second detecting means (270*a*–271*b*; 270*a*).

13. An excavation area limiting control system for a construction machine according to claim 12, wherein said manipulation system includes a first pilot line (44*a*) for introducing a pilot pressure to the corresponding hydraulic control valve (5*a*) so that said front device (1A) is moved away from said set area, and wherein said pilot pressure modifying means includes electro-hydraulic converting means (10*a*) for converting said electric signal into a hydraulic signal and higher pressure selecting means (12) for selecting a higher one of the pilot pressure in said first pilot line and the hydraulic signal output from said electro-hydraulic converting means, and introducing the selected pressure to said corresponding hydraulic control valve.

14. An excavation area limiting control system for a construction machine according to claim 13, wherein said manipulation system includes second pilot lines (44*b*/45*a*/45*b*) for introducing pilot pressures to the corresponding hydraulic control valves (5*a*/5*b*) so that said front device (1A) is moved toward said set area, and wherein said pilot pressure modifying means includes pressure reducing means (10*b*/11*a*/11*b*) disposed in said second pilot lines for reducing the pilot pressures in said second pilot lines in accordance with said electric signals.

15. An excavation area limiting control system for a construction machine according to claim 2, wherein said third calculating means (9*e*) maintains said input target speed vector (Vc) as it is when said front attachment (1A) is within said set area but not near the boundary of said set area.

16. An excavation area limiting control system for a construction machine according to claim 2, wherein the vector component of said input target speed vector (Vc) in the direction toward the boundary of said set area is a vector component vertical to the boundary of said set area.

17. An excavation area limiting control system for a construction machine according to claim 2, wherein said third calculating means (9*e*) reduces the vector component of said input target speed vector (Vc) in the direction toward the boundary of said set area such that an amount of reduction in said vector component is increased as a distance between said front device (1A) and the boundary of said set area decreases.

18. An excavation area limiting control system for a construction machine according to claim 4, wherein said third calculating means (9*g*) modifies said input target speed vector (Vc) so that said front device (1A) is returned to said set area, by changing a vector component of said input target speed vector (Vc) in the direction vertical to the boundary of said set area into a vector component in the direction toward the boundary of said set area.

19. An excavation area limiting control system for a construction machine according to claim 4, wherein said third calculating means (9*g*) reduces the vector component in the direction toward the boundary of said set area as a distance between said front device (1A) and the boundary of said set area decreases.

20. An excavation area limiting control system for a construction machine according to claim 1, wherein said front device (1A) includes a boom (1*a*) and an arm 1(*b*) of a hydraulic excavator.

21. An excavation area limiting control system for a construction machine according to claim 20, wherein said particular front actuators include at least a boom cylinder (3*a*) for driving said boom (1*a*), and said second detecting means include at least means (270*a*) for detecting a load pressure in the boom-up direction.

* * * * *